US008816867B2

(12) United States Patent
Mammoto et al.

(10) Patent No.: US 8,816,867 B2
(45) Date of Patent: Aug. 26, 2014

(54) DETECTOR

(75) Inventors: Atsuchi Mammoto, Tokyo (JP); Hiromichi Ebata, Tokyo (JP)

(73) Assignee: HOCHIKI Corporation, Tokyo (JP)

( * ) Notice: Subject to any disclaimer, the term of this patent is extended or adjusted under 35 U.S.C. 154(b) by 26 days.

(21) Appl. No.: 13/549,305

(22) Filed: Jul. 13, 2012

(65) Prior Publication Data

US 2013/0008787 A1 Jan. 10, 2013

Related U.S. Application Data

(63) Continuation-in-part of application No. PCT/JP2011/000218, filed on Jan. 18, 2011.

(30) Foreign Application Priority Data

Jan. 21, 2010 (JP) ..... 2010-010860

(51) Int. Cl.
*G08B 17/00* (2006.01)

(52) U.S. Cl.
CPC ..... *G08B 17/00* (2013.01)
USPC ..... 340/632; 340/628; 340/630; 340/573.1; 340/578; 204/407; 204/415; 204/431

(58) Field of Classification Search
USPC ..... 340/632, 628, 630, 573, 578; 204/407, 204/415, 431
See application file for complete search history.

(56) References Cited

U.S. PATENT DOCUMENTS

| | | | | |
|---|---|---|---|---|
| 6,166,648 | A * | 12/2000 | Wiemeyer et al. | 340/630 |
| 6,661,346 | B1 * | 12/2003 | Wood et al. | 340/601 |
| 7,218,239 | B2 * | 5/2007 | Ropke | 340/628 |
| 7,365,846 | B2 * | 4/2008 | Hess et al. | 356/338 |
| 2004/0079637 | A1 | 4/2004 | Maeno et al. | |
| 2008/0116083 | A1 * | 5/2008 | Kuhn | 205/780.5 |

FOREIGN PATENT DOCUMENTS

| | | | |
|---|---|---|---|
| CN | 1186232 | A | 7/1998 |
| GB | 2306218 | A | 4/1997 |
| JP | 07-239988 | A | 9/1995 |
| JP | 11-312286 | A | 11/1999 |
| JP | 2004-117307 | A | 4/2004 |
| JP | 2004-258968 | A | 9/2004 |
| JP | 2006-268119 | A | 10/2006 |
| JP | 2009-008511 | A | 1/2009 |
| JP | 2009-140446 | A | 6/2009 |

* cited by examiner

*Primary Examiner* — Tai T Nguyen
(74) *Attorney, Agent, or Firm* — Blank Rome LLP

(57) ABSTRACT

A detector includes a smoke detecting section that includes a light-receiving unit at a position at which the light-receiving unit does not directly receive light emitted by a light-emitting unit in a chamber in which a labyrinth for preventing light from directly entering from the outside and an insect net covering the rim of the labyrinth are provided, the light-receiving unit receiving light scattered by smoke flowing into the chamber. An opening hole is formed open in the surface of the cover receiving hot air current, of the detector. In the cover behind the opening hole, an electrochemical gas sensor is placed to bring gas generated by a fire through the opening hole into contact with an electrolyte solution to detect the gas by an electrode.

24 Claims, 22 Drawing Sheets

(A)

(B)

(A)

(B)

(A)

(B)

(A)

(B)

DETECTOR

CROSS-REFERENCE TO RELATED APPLICATIONS

The present application claims the benefit and is a Continuation-in-Part application of International Patent Application No. PCT/JP2011/000218, filed Jan. 18, 2011, and Japanese Patent Application No. 2010-01060, filed Jan. 21, 2010, the entire disclosures of which are incorporated by reference herein.

BACKGROUND OF THE INVENTION

1. Field of the Invention

The present invention relates to a composite-type detector for detecting a fire by detecting the concentration of a gas generated by the fire, such as CO, in addition to detecting smoke density and temperature due to the fire.

2. Description of the Related Art

A generally known conventional detectors for giving a fire alarm by detecting a fire and providing an alarm activation signal to a receiver are a smoke detector for detecting smoke from a fire and a heat detector for detecting heat (temperature) from a fire.

However, with detected information such as temperature or smoke density alone, it may be difficult to quickly and appropriately respond to various types of fires including smoldering fire and flaming fire. So, as an solution for that problem, a composite-type detector is known that quickly detects a fire without false detection and misdetection by detecting smoke density and temperature due to a fire and comprehensively determining whether or not a fire has occurred.

On the other hand, it is known that, in addition to smoke and heat, gas, such as CO, is generated by a fire. So, another composite-type detector is also known that includes a gas sensor to detect gas concentration in addition to smoke and heat for fire determination.

SUMMARY OF THE INVENTION

It is an object of the present invention to solve the problems of the above mentioned prior arts.

One aspect of the present invention provides a detector for detecting a fire and gas, comprising:

a detector cover that receives hot air current;

a fire sensor, placed inside the detector cover, for detecting a fire; and an electrochemical gas sensor, placed inside the detector cover, for detecting gas with an electrode by contacting the gas with an electrolyte solution, wherein, in the detector cover, a container for containing a detecting space section for detecting a fire by the fire sensor is provided and an intake for causing the hot air current to flow into the container is formed, and wherein an opening hole for introducing gas included in the hot air current into the electrochemical gas sensor is formed so as to be open to a flow path of the hot air current from the surface of the detector cover through the intake to the detecting space section.

DETAILED DESCRIPTION OF THE PREFERRED EMBODIMENTS

Before explaining embodiments of the present inventions, exemplary problems to be solved by the embodiments will be explained.

A composite-type detector that is a conventional smoke detector equipped with a gas sensor includes the gas sensor in a chamber in which a smoke detecting section for detecting smoke incoming from a fire using a scattered light method is provided or in a chamber separated from the smoke detecting section in a detector main body. So, when smoke including gas flows into the chamber from a fire, the temporal change in the detected smoke density is similar to that in the detected gas concentration. Thus, the result of fire determination by smoke density is almost the same as that by gas concentration, in which "composite-type" may not be so beneficial.

Figure 24:
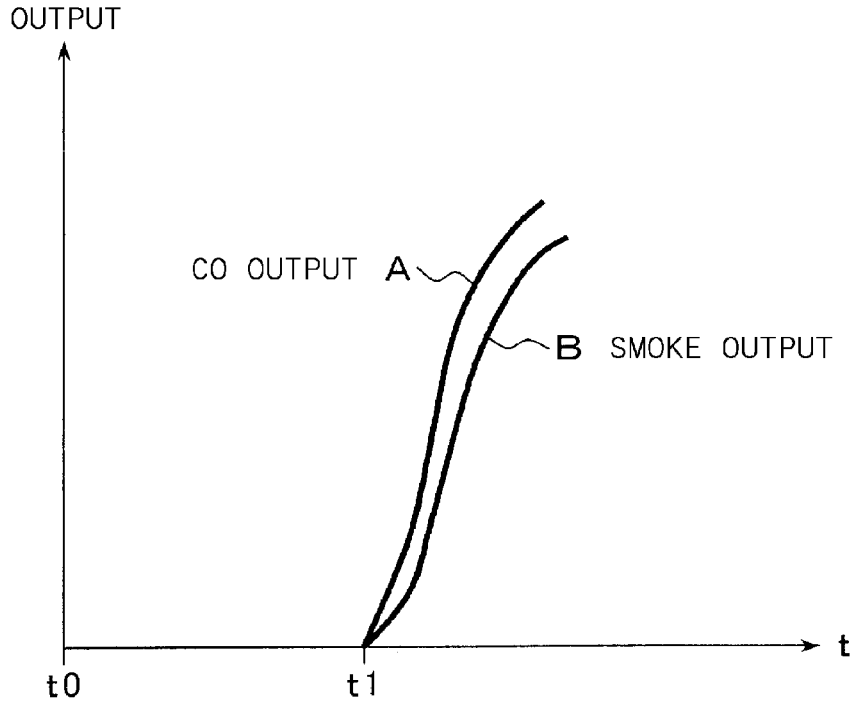
FIG. 24 is a time chart showing a temporal changes in CO output and smoke output when a conventional detector receives hot air current.

FIG. 24 is a time chart showing the temporal changes in smoke density and CO gas concentration when a fire occurs, detected by a composite-type detector with a CO sensor provided in a chamber of a smoke detector.

Here, a smoke detecting section of the smoke detector, including a light-receiving unit at a position at which the light-receiving unit does not directly receive light emitted by a light-emitting unit in a chamber in which a labyrinth for preventing light from directly entering from the outside and an insect net having a plurality of small holes open and covering the rim of the labyrinth are provided, receives with a light-receiving device light scattered by smoke flowing through the insect net and the labyrinth into the chamber, and determines smoke density from a light-receiving signal given by the light-receiving device.

Because of this structure of the smoke detecting section, when the smoke detecting section receives hot air current due to a fire at time t0 in FIG. 24, smoke including CO gas flows into the chamber with some delay, then the detected smoke density (smoke output) and the detected CO gas concentration (CO output) start to increase at time t1. Accordingly, when the smoke output and the CO output are compared using a predetermined smoke threshold and CO threshold for determining whether or not a fire has occurred, since the temporal change in the smoke output is similar to that in the CO output, the occurrence of a fire is determined almost at the same time as each other, in which "composite-type" may not be so beneficial.

Much the same is true in a composite-type detector including a gas sensor in a chamber separated from the smoke detecting section. In a conventional structure, the composite-type detector has a hole in a detector cover for introducing gas, the hole leading to a closed space containing a CO sensor in a main body of the detector. A conventional gas sensor is generally a low-cost semiconductor-type gas sensor. However, since the semiconductor-type sensor generally has a poor selectivity in detecting gas, removing unnecessary gas, such as a non-detection-target gas, and detecting a certain detection-target gas is needed.

Accordingly, in order to possibly prevent non-detection-target gas from penetrating the chamber to cause sensor degradation or false detection or in order to minimize the adverse effects of humidity, the sensor needs to be placed in a chamber far from an introduction hole provided a detector cover. In this arrangement, when a fire occurs, the response of the CO sensor to incoming CO gas as a detection target is delayed for the distance from the introduction hole to the CO sensor placed in the chamber, which reduces the detection sensitivity advantage over the smoke detector.

Furthermore, for detection accuracy, the semiconductor-type sensor suffers from low resolution when gas has a low concentration as in the early stage of a fire. Accordingly, for CO gas, effective detection accuracy is obtained, for example, with a gas concentration of 50 ppm or more, so it is difficult to determine the early stage of a fire with a gas concentration of less than 50 ppm. Furthermore, a sensor device uses a heater, which increases power consumption.

Embodiments of a detector in accordance with the invention and their respective variations are described below with reference to the accompanying drawings. However, these embodiments and variations are not intended to limit the invention.

First Embodiment

First, a first embodiment is described. This embodiment relates to a detector including a smoke sensor and a gas sensor.

Figure 1:
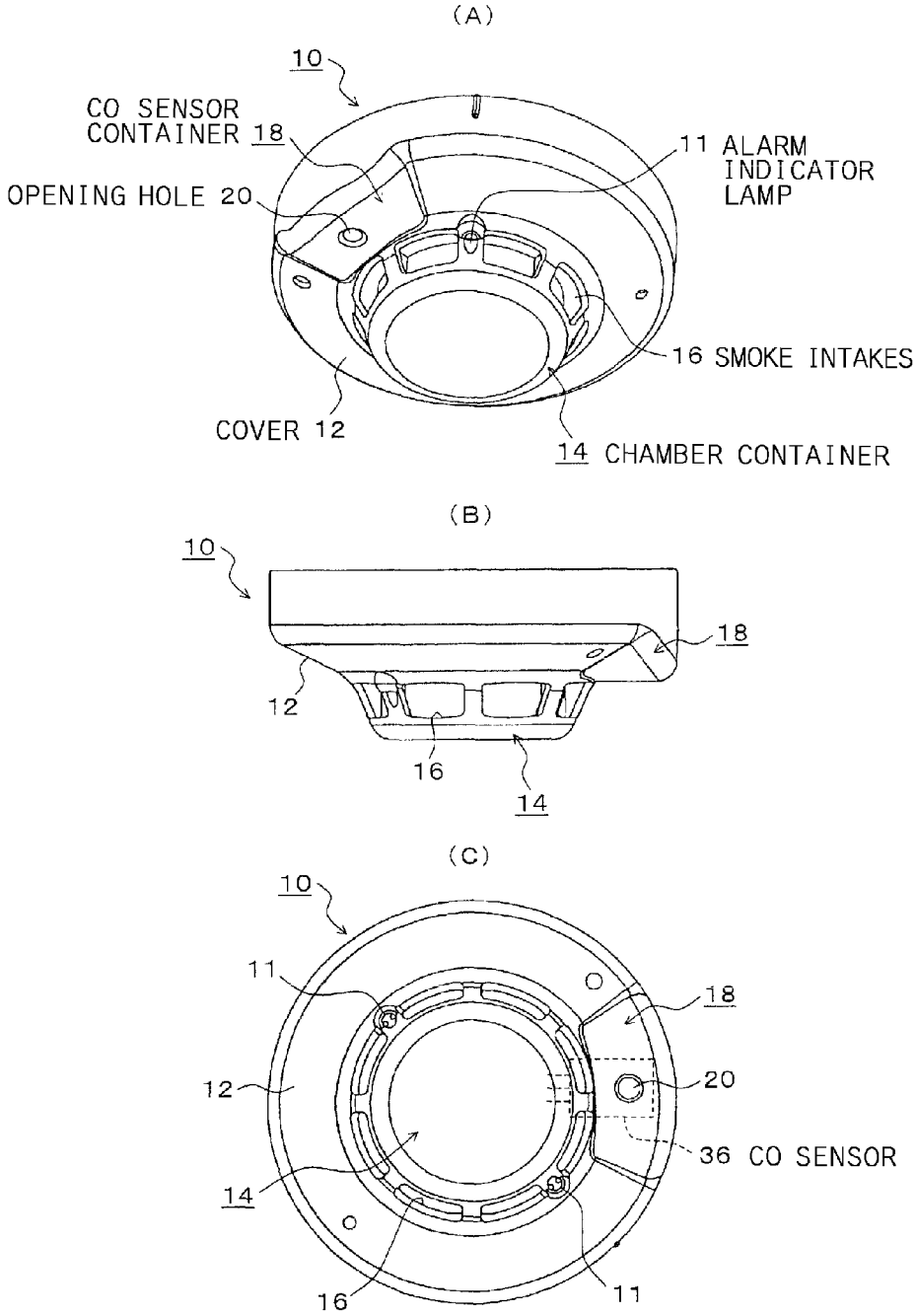
FIG. 1 is an illustration showing a first embodiment of a detector for detecting smoke and CO in accordance with the invention.

FIG. 1 is an illustration showing an embodiment of a composite-type detector in accordance with the invention, including a smoke sensor as a fire sensor and a CO sensor as a gas sensor for detecting gas generated by a fire. FIG. 1(A) is a view seen from below of the detector mounted on a ceiling surface. FIG. 1(B) is a side view of the detector. FIG. 1(C) is a plan view seen from below of the detector.

In FIG. 1, a detector 10 of the embodiment includes: a detector main body contained in the detector 10; and a cover (detector cover) 12 placed outside the main body. The cover 12 includes a chamber container (container) 14 formed downwardly from the center of an approximately cylindrical base portion. A plurality of smoke intakes (intakes) 16 are open around the chamber container 14. An alarm activation indicator lamp 11 is provided on the side surface of the mounting side of the cover 12.

A CO sensor container 18 is formed by protruding a portion of the cover 12 outside the chamber container 14. An electrochemical CO sensor 36 is built in the CO sensor container 18 as shown by a dotted line in FIG. 1(C). An opening hole 20 is formed on the surface of the cover 12 of the CO sensor container 18 so as to introduce CO gas with smoke flowing through hot air current due to a fire, into the internal CO sensor 36.

Figure 2:
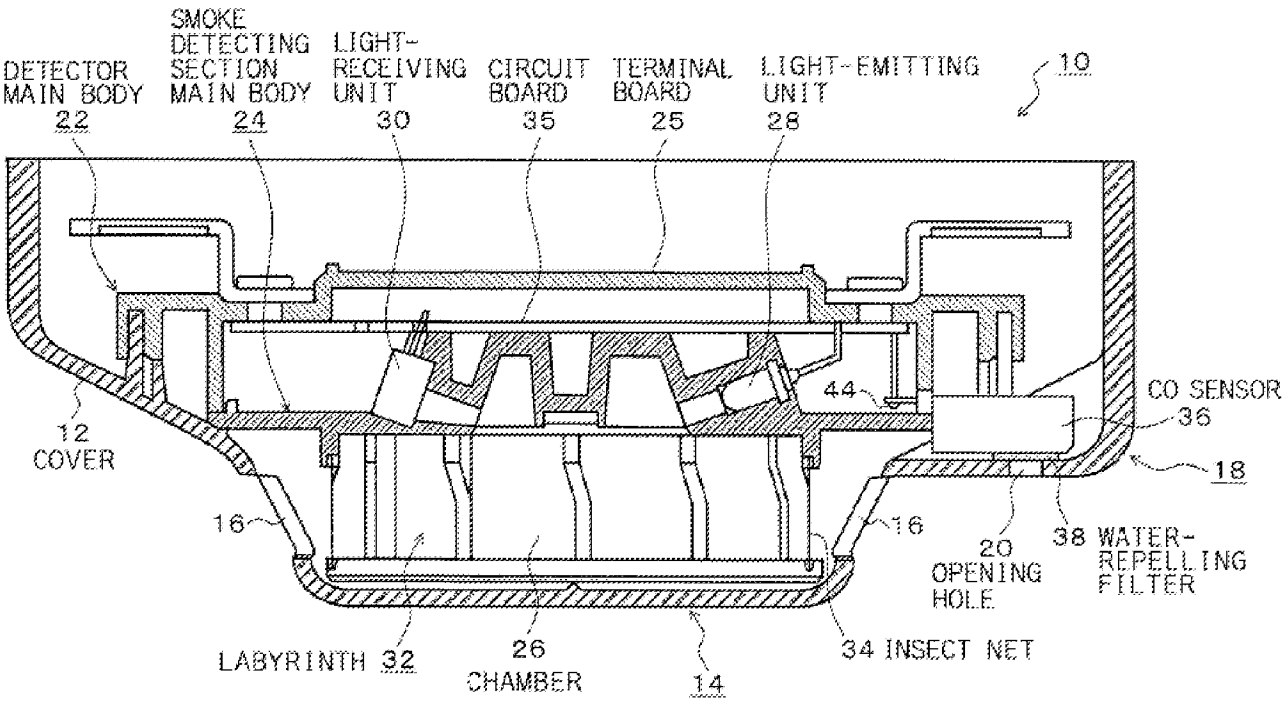
FIG. 2 is a cross-sectional view showing an internal structure of the detector in FIG. 1.

FIG. 2 is a cross-sectional view showing an internal structure of the detector in FIG. 1. In FIG. 2, the detector 10 includes a detector main body 22 and the cover 12. The detector main body 22 includes: a labyrinth 32 mounted on the bottom portion of a smoke detecting section main body 24; and a terminal board 25 mounted on the top portion of the smoke detecting section main body 24.

A chamber 26 serving as a smoke detecting space (detecting space section) is formed in the labyrinth 32 placed on the bottom portion of the smoke detecting section main body 24. The labyrinth 32 forms a route for smoke to easily flow into the chamber 26 from the outside while preventing light from entering from the outside. The labyrinth 32 includes an insect net 34 mounted covering the rim of the labyrinth 32. The smoke intakes 16 are open in a portion of the cover 12 corresponding to the rim of the labyrinth 32 on which the insect net 34 is mounted.

The smoke detecting section main body 24 includes: a circuit board 35 placed on the top surface (back side); and a light-emitting unit 28 and a light-receiving unit 30 provided on the side of the chamber 26. The light-emitting unit 28 and the light-receiving unit 30 are connected by leads to the circuit board 35 that performs light emission driving and light reception processing.

The light-emitting unit 28 emits light toward the chamber 26 through a light-emitting side opening so that scattered light generated when the light hits a smoke particle flowing into the chamber 26 will enter the light-receiving unit 30 through a light-receiving side opening.

In the detector 10 of the embodiment, the light-emitting unit 28 and the light-receiving unit 30 are placed in the smoke detecting section main body 24 so that an optical axis from the light-emitting unit 28 to the chamber 26 and an optical axis of light scattered by a smoke particle in the chamber 26 directed to the light-receiving unit 30 intersect at a predetermined angle in horizontal direction and at a predetermined angle even in extension direction.

The CO sensor container 18 is formed by protruding a portion of the cover 12 on the right of the chamber 26. The electrochemical CO sensor 36 is placed with its detecting surface in contact with or close to the inner surface of the protruded CO sensor container 18. The CO sensor 36 has a water-repelling filter 38 on its detecting surface. At the center of the water-repelling filter 38, a gas intake hole is open for introducing CO gas into the CO sensor 36.

The opening hole 20 is formed on the downward surface of the CO sensor container 18 of the cover 12. The CO sensor 36 is placed with respect to the opening hole 20 such that the opening hole 20 is positioned at the center of the water-repelling filter 38 provided on the detecting surface of the CO sensor 36. The CO sensor 36 has a lead 44 that is connected to the circuit board 35 directly or with a connecting hardware to provide a detection signal according to CO gas concentration.

Figure 3:
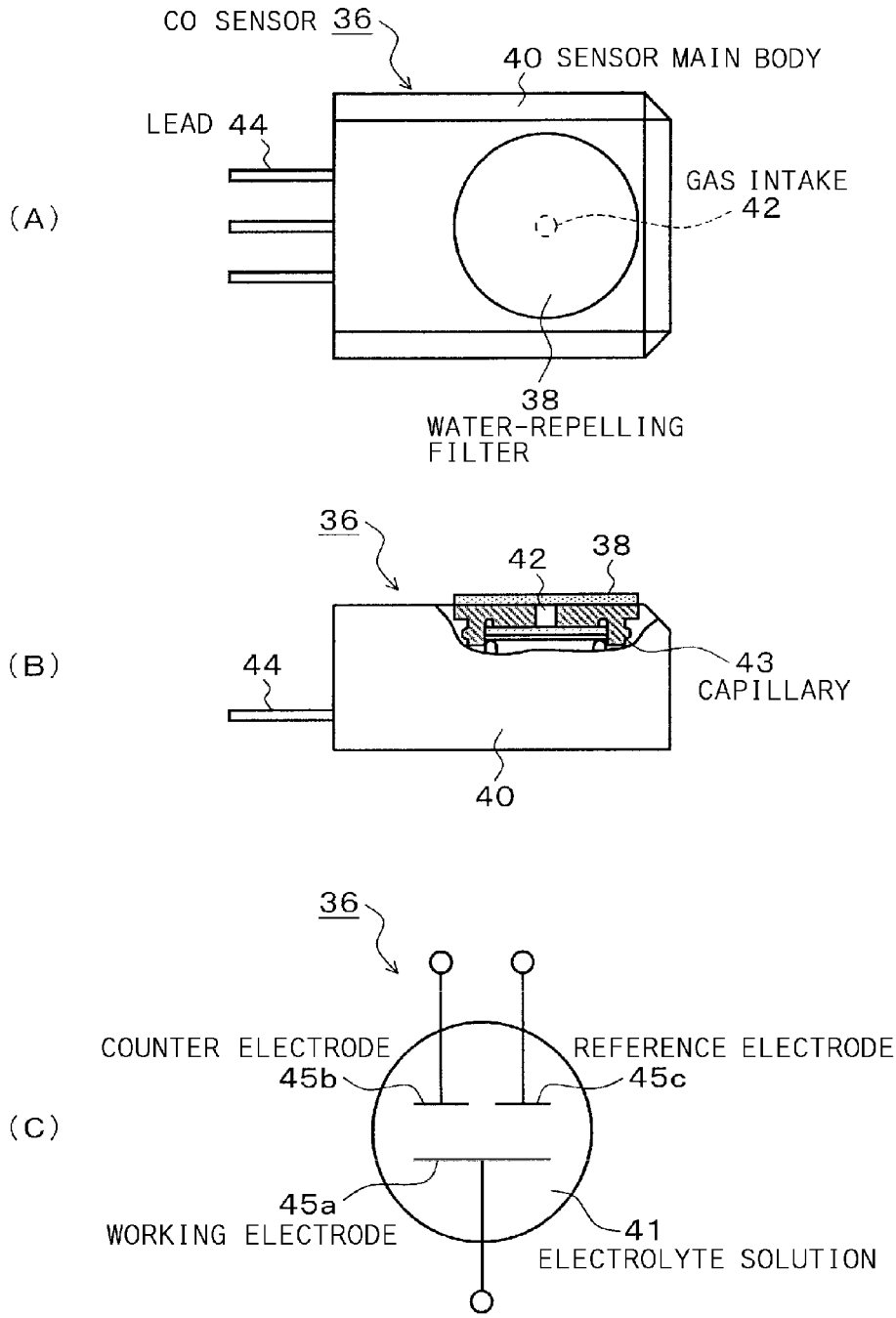
FIG. 3 is an illustration showing an electrochemical CO sensor used for the embodiment in FIG. 1.

FIG. 3 is an illustration showing the electrochemical CO sensor used for the embodiment shown in FIG. 1. FIG. 3(A) is a front view of the CO sensor seen from the detecting surface side. FIG. 3(B) is a side view of the CO sensor. FIG. 3(C) shows a symbolized internal electrode structure of the CO sensor.

As shown in FIGS. 3(A) and 3(B), the CO sensor 36 includes a block-shaped sensor main body 40. On the detecting surface of sensor main body 40, the water-repelling filter 38 is mounted to prevent the adhesion of water from the outside. At the center of the water-repelling filter 38, a gas intake 42 is placed open and communicated with the inside.

As seen from the structure shown in a partially cross-sectional manner in FIG. 3(B), the gas intake 42 is formed at the center of a capillary 43 mounted as a lid member on the sensor main body 40, and the water-repelling filter 38 is mounted so as to cover the gas intake 42 outside the capillary 43.

The water-repelling filter 38, formed of, for example, polytetrafluoroethylene (PTFE) or the like, has both dust resistance and water resistance, allowing CO gas to pass therethrough while preventing dust, water and the like from penetrating the gas intake 42.

The sensor main body 40 has three leads 44 pulled out on the left. For example, the sensor main body 40 has a size of, but not limited to, approximately 20 by 15 by 10 millimeters, close to the size of a caramel.

FIG. 3(C) shows a 3-pin electrochemical CO sensor as an example of the CO sensor used for the embodiment. The CO sensor 36 is filled with an electrolyte solution 41 exposed to outside air and includes a working electrode 45*a*, a counter electrode 45*b* and a reference electrode 45*c* which are placed a distance from one another and immersed in the electrolyte solution 41.

When CO gas from the outside comes into contact with the electrolyte solution 41 of the CO sensor 36, current due to oxidation of CO gas flows from the working electrode 45*a* into the proximity of the working electrode 45*a*. The current flowing from the working electrode 45*a* is proportional to the gas concentration of CO gas coming into contact with the CO sensor 36.

An amplifier circuit is connected to the working electrode 45*a*. The amplifier circuit amplifies voltage input proportional to current input from the working electrode 45*a* to provide CO detection signal that increases according to gas concentration from a normal voltage with a CO gas concentration of approximately 0 ppm.

Furthermore, when the CO sensor 36 is in operation, a voltage Vc applied to the counter electrode 45*b* is controlled by an external circuit so that the difference between a predetermined reference voltage Vr (=0.5 volts) and a voltage Vs of the reference electrode 45*c* will be 0 volt, resulting in maintaining the potential difference between the working electrode 45*a* and the counter electrode 45*b* to be always zero.

Figure 4:
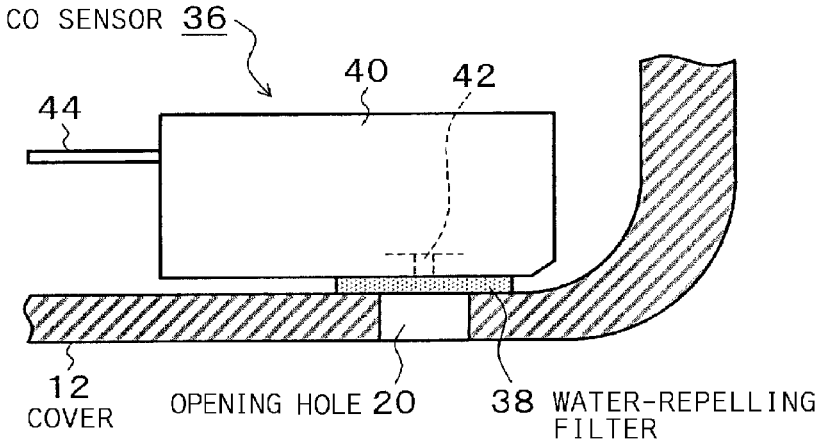
FIG. 4 is an illustration showing an embodiment of a CO sensor container in FIG. 1.
Figure 4:
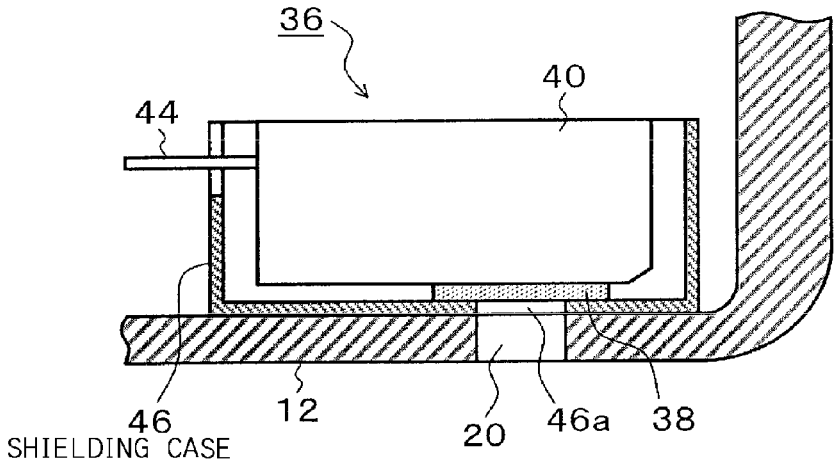

FIG. 4 is an illustration showing an embodiment of the CO sensor container 18 shown in FIG. 1. FIG. 4(A) shows a portion of the CO sensor container 18 shown in FIG. 2. The CO sensor 36 is placed behind the opening hole 20 that is open in the cover 12 so that the gas intake 42 of the capillary 43 provided at the center of the water-repelling filter 38 is opposite the opening hole 20.

Here, a diameter d1 of the gas intake 42 of the CO sensor 36, a diameter d3 of the water-repelling filter 38 and a diameter d2 of the opening hole 20 open in the cover 12 are set into a relation:

$$d1<d2<d3.$$

For example, with d1≤1 mm and d3=10 mm, d2≤5 mm.

Thus, the detecting surface of the CO sensor 36 is in contact with the opening hole 20 of the cover 12 to close the inner side of the opening hole 20. Accordingly, when hot air current causes CO gas to come into contact with the surface of the cover 12, the CO gas flows into the gas intake 42 of the CO sensor 36 through the opening hole 20 and is immediately detected. Especially even in the early stage of a fire with weak hot air current, the CO sensor 36 can directly take in CO gas, improving the fire detection sensitivity.

Using an electrochemical scheme, the CO sensor 36 of the invention has a linear output characteristic with respect to gas concentration and can detect gas in low concentration range in the early stage of a fire with a few ppm resolution, increasing the benefit of using "composite-type." Furthermore, the electrochemical scheme is excellent in gas selectivity and is less subject to humidity, which can prevent false detection due to outside air other than detection-target gas.

Furthermore, the water-repelling filter 38 is in contact with the inner surface of the cover 12 around the opening hole 20, which can prevent water from the outside from penetrating the detector. Furthermore, in contrast to a semiconductor-type sensor, the CO sensor does not need a heater, which can reduce the power consumption of the sensor itself.

FIG. 4(B) shows another embodiment of the CO sensor container used for the embodiment, wherein the CO sensor 36 is contained in a shielding case 46. The shielding case 46 is a box-shaped metallic body that is open toward the inside, contains the CO sensor 36, has an opening hole 46*a* opposite the opening hole 20 open in the cover 12, and includes the water-repelling filter 38 positioned such that the internal gas intake 42 is positioned at the center of the water-repelling filter 38 and opposite the opening hole 46*a*.

Thus, the CO sensor 36 is contained in the shielding case 46, which can prevent external noise from being superimposed on the electrodes provided in the CO sensor 36 as shown in FIG. 3(C) and can maintain good signal-to-noise ratio of detection signal of CO gas output from the working electrode 45*a*.

Figure 5:
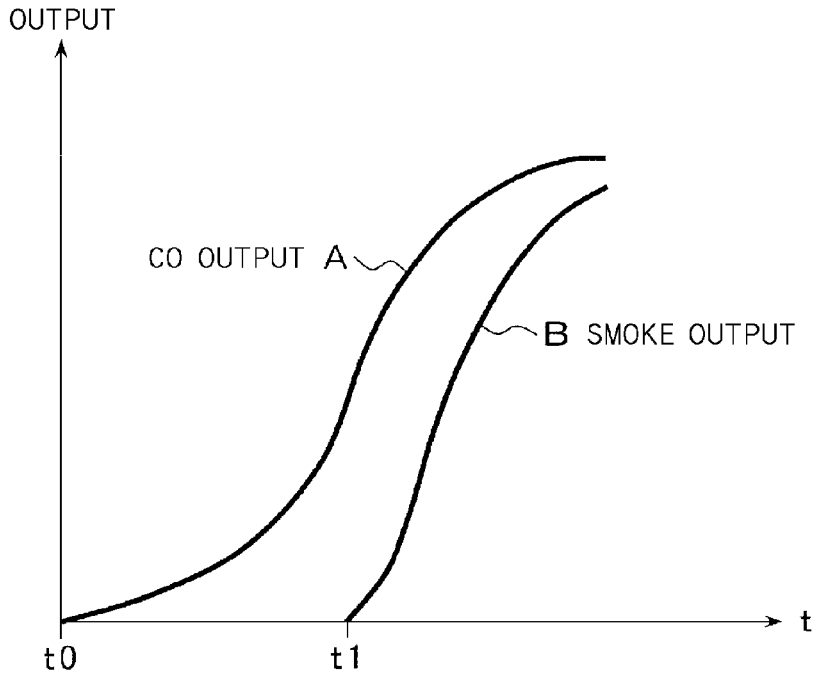
FIG. 5 is a time chart showing detection characteristics of smoke and CO in the embodiment in FIG. 1.

FIG. 5 is a time chart showing detection characteristics of smoke and CO in the embodiment shown in FIG. 1. The detector 10 shown in FIG. 1 in accordance with the invention is mounted on the ceiling surface and receives hot air current due to a fire coming along the ceiling surface, the hot air current including smoke and CO gas due to the fire. If the detector 10 starts to receive hot air current including smoke and CO gas due to a fire at a time t0 in FIG. 5, CO gas included in the hot air current is introduced into the internal CO sensor 36 through the opening hole 20 open in the CO sensor container 18 with almost no time delay, and the detection signal of CO gas concentration detected by the CO sensor 36 appears at the time t0 and increases with time, as shown by a CO output A.

On the other hand, smoke included in the hot air current is introduced into the chamber container 14 through the smoke intakes 16 provided around the chamber container 14. As seen from the cross-sectional view of FIG. 2, in the chamber container 14, the insect net 34 is provided behind the smoke intakes 16, then the labyrinth 32 is provided behind the insect net 34, and then the chamber 26 is provided in the innermost of the labyrinth 32.

Accordingly, it takes some time (delay) for smoke carried by the hot air current to flow into the chamber 26 through the smoke intakes 16, the insect net 34 and the labyrinth 32. Accordingly, as shown by a smoke output B in FIG. 5, the smoke output appears at a time t1 at which some time has elapsed from the time t0 when the detector 10 started to receive the hot air current including smoke, and increases with time.

Thus, in the detector including the CO sensor and the smoke detecting section in accordance with the invention, a time lag occurs between the detection characteristics of CO gas and smoke, causing CO gas to be detected earlier and then smoke to be detected.

This time lag between the detection characteristics of CO gas and smoke enables fire determination based on CO gas and fire determination based on smoke to be performed by different determination criteria, which allows a fire alarm activation to be determined based on one of the above fire determinations or based on a combination of both the fire determinations.

Figure 6:
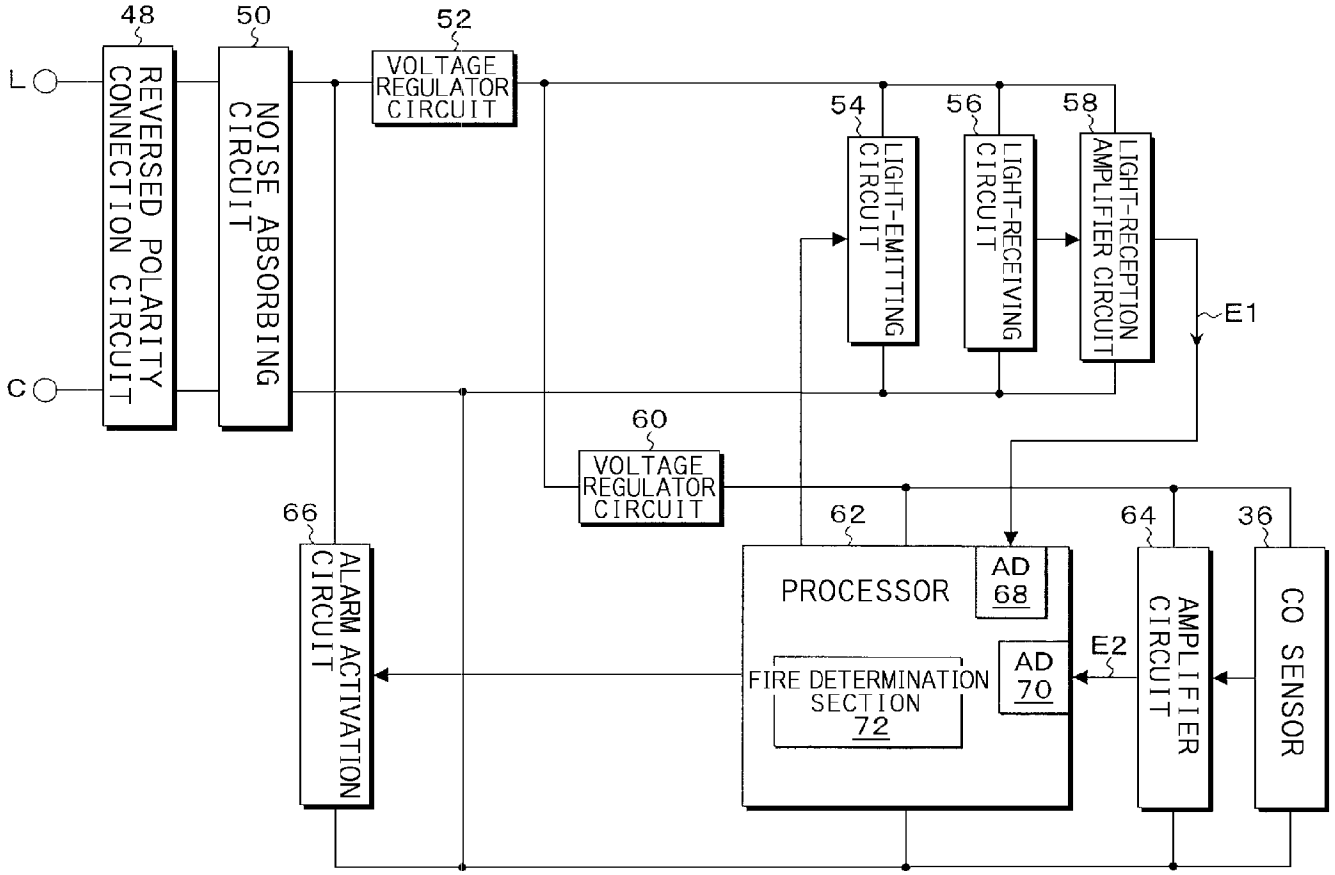
FIG. 6 is a block diagram showing a detector circuit in the embodiment in FIG. 1.

FIG. 6 is a block diagram showing a detector circuit in the embodiment shown in FIG. 1. In FIG. 6, the detector circuit has an L terminal and a C terminal to which a detector line (power supply/signal line) led from a receiver is connected.

Next to the L and C terminals, a reversed polarity connection circuit 48 is provided. The reversed polarity connection circuit 48 includes a diode bridge and is configured to provide a voltage with a fixed polarity whether the L and C terminals are connected to the positive and negative side or the negative and positive side, respectively, of the detector line. Next, a noise absorbing circuit 50 is provided that is configured to absorb and remove surge, noise and others generated on the detector line.

Next, a voltage regulator circuit 52 is provided that is configured to convert a power supply voltage supplied from the detector line into a predetermined power supply voltage. The power supply voltage from the voltage regulator circuit 52 is supplied to a light-emitting circuit 54, a light-receiving circuit 56 and a light-reception amplifier circuit 58. The light-emitting circuit 54 intermittently light-emission-drives an LED included in the light-emitting unit 28 shown in FIG. 2. The light-receiving circuit 56 receives a light reception signal from a photodiode included in the light-receiving unit 30 shown in FIG. 2. The light-reception amplifier circuit 58 amplifies a weak light reception signal obtained from the light-receiving circuit 56 and provides a smoke detection signal E1 corresponding to smoke density.

The power supply voltage provided by the voltage regulator circuit 52 is further converted into a lower constant voltage by a voltage regulator circuit 60 that provides a power supply voltage to a processor 62, the electrochemical CO sensor 36 and an amplifier circuit 64. The processor 62 is a processor known as a one-chip CPU that includes a CPU, a RAM, a ROM, A/D conversion ports and various I/O ports.

The CO sensor 36 has an electrode structure as shown in FIG. 3(C), and the amplifier circuit 64, specifically, for example, a differential amplifier provided therein, inverting-amplifies an input voltage proportional to a current flowing in the working electrode 45*a* to provide a CO detection signal E2 proportional to CO gas concentration.

The processor 62 converts the smoke detection signal E1 from the light-reception amplifier circuit 58 into smoke data by an A/D converter 68 and converts the CO detection signal E2 obtained from the amplifier circuit 64 into CO data.

The processor 62 includes a fire determination section 72 that is implemented by the CPU executing a program. The fire determination section 72 determines a fire alarm activation according to a predetermined fire determination procedure based on the smoke data and CO data read through the A/D converters 68, 70.

An alarm activation circuit 66 is provided on the output side of the processor 62. The alarm activation circuit 66 is connected to the output side of the noise absorbing circuit 50. When the fire determination section 72 of the processor 62 determines a fire alarm activation, in response to a fire alarm activation signal, a switching device provided in the alarm activation circuit 66 is activated to transmit an activation signal to the receiver by causing an alarm activation current to flow in the detector line connected to the L and C terminals from the P-type receiver, Furthermore, the alarm activation circuit 66 includes the alarm activation indicator lamp 11 shown in FIG. 1(A) and activates the alarm activation indicator lamp 11 at the same time as causing the alarm activation current to flow. After the processor 62 activates the alarm activation circuit 66 to provide the alarm activation signal, the alarm-activating state is terminated when the receiver shuts off power supply to the detector line, then the process performs a recovery operation to return to the normal-monitoring state.

Figure 7:
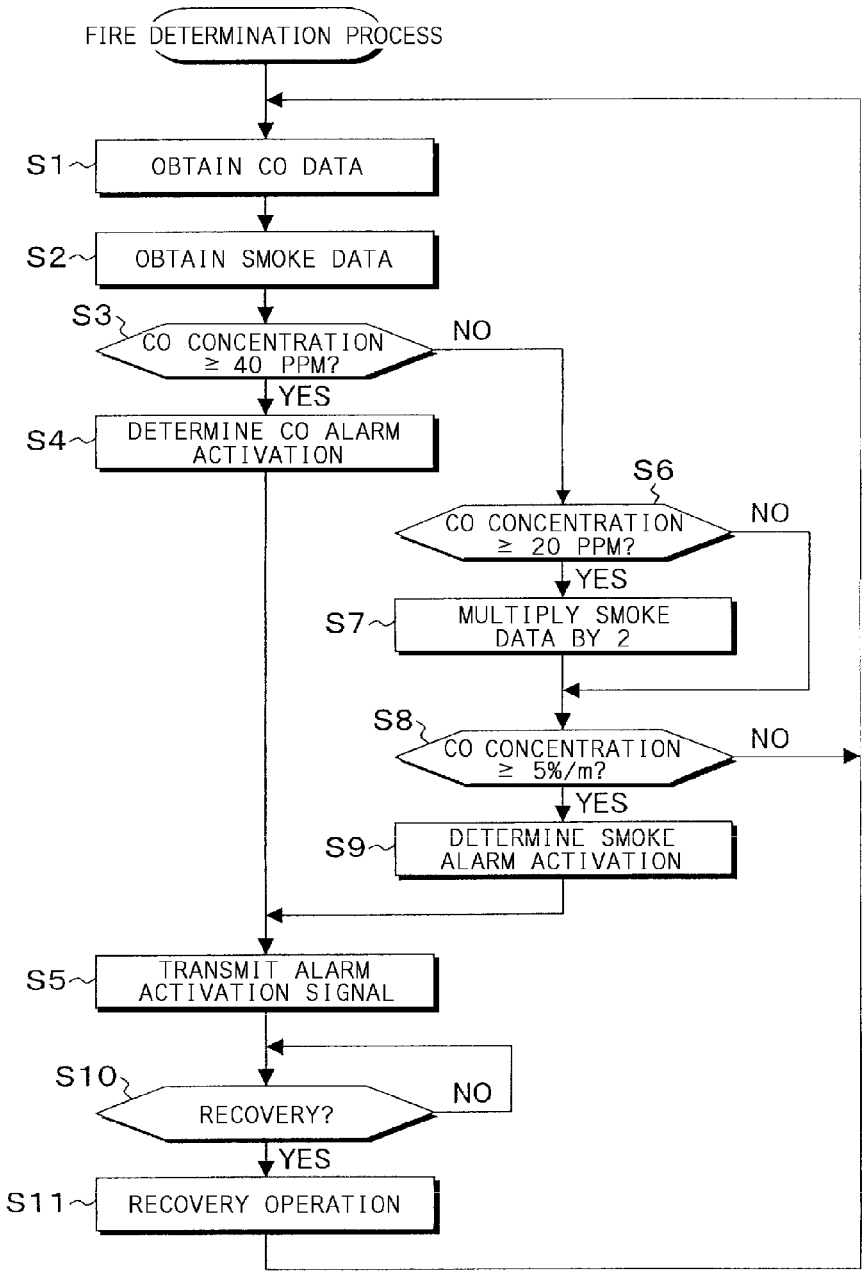
FIG. 7 is a flowchart showing a fire determination process by the detector circuit in FIG. 6.

FIG. 7 is a flowchart showing a fire determination process performed by the fire determination section 72 provided in the processor 62 of the detector circuit shown in FIG. 6. In FIG. 7, the fire determination process, in step S1, obtains CO data detected by the CO sensor 36, then in step S2, obtains smoke data obtained by a scattered-light type smoke detecting structure, and then in step S3, determines whether or not the CO concentration is equal to or more than a predetermined threshold concentration of 40 ppm. If determined in step S3 that the CO concentration is equal to or more than 40 ppm, the process proceeds to step S4 to determine a CO alarm activation, then transmits an alarm activation signal in step S5.

If determined in step S3 that the CO concentration is less than 40 ppm, the process proceeds to step S6 to determine whether or not the CO concentration is equal to or more than a predetermined concentration less than that of the step 3, e.g., 20 ppm. If determined in step S6 that the CO concentration is equal to or more than 20 ppm, the process proceeds to step S7 to multiply the smoke data obtained in step S2 by a predetermined correction coefficient that is equal to or more than 1. For example, in this embodiment, the smoke data is multiplied by 2.

Increasing the smoke data by multiplying by the correction coefficient equal to or more than 1 in this way enables fire determination using emphasized smoke data. Specifically, if determined in step S6 that the CO concentration is equal to or more than 20 ppm, it is very likely due to a fire. So, in this stage, instead of determining the smoke data as it is, the smoke density is determined with the smoke data emphasized by multiplying by, for example, 2, which enables quick fire determination.

After multiplying the smoke data by 2 in step S7, in step S8, the process determines whether or not the smoke density is equal to or more than a predetermined threshold for fire determination, e.g., 5%/m. If determined that the smoke density is equal to or more than 5%/m, the process determines smoke alarm activation in step S9, then transmits an alarm activation signal to the receiver in step S5.

On the other hand, if determined in step S6 that the CO concentration is less than 20 ppm, the emphasis by multiplying the smoke data by 2 in step S7 is not performed, and, in step S8, the comparative determination of the smoke density is performed using the smoke data obtained in step S2 as it is.

After transmitting the alarm activation signal to the receiver in step S5, in step S10, the process monitors a power supply shut-off and a recovery after the shut-off of the detector line caused by a recovery operation on the receiver side, and, when a recovery is detected, the process performs the recovery operation in step S11 to return to the normal-monitoring state in step S1.

Note that the detector is recovered by the power supply shut-off of the detector line. However, the detector is not limited to this. In a system in which the receiver is in communication with the detector by signal transmission, the detector may perform the recovery operation in response to receiving a recovery signal from the receiver. Or the recovery operation may also be automatically performed by the detector without depending on the recovery operation on the receiver side. Furthermore, also after the fire alarm activation, obtaining data from the sensors and determining a fire may be repeatedly performed.

Figure 8:
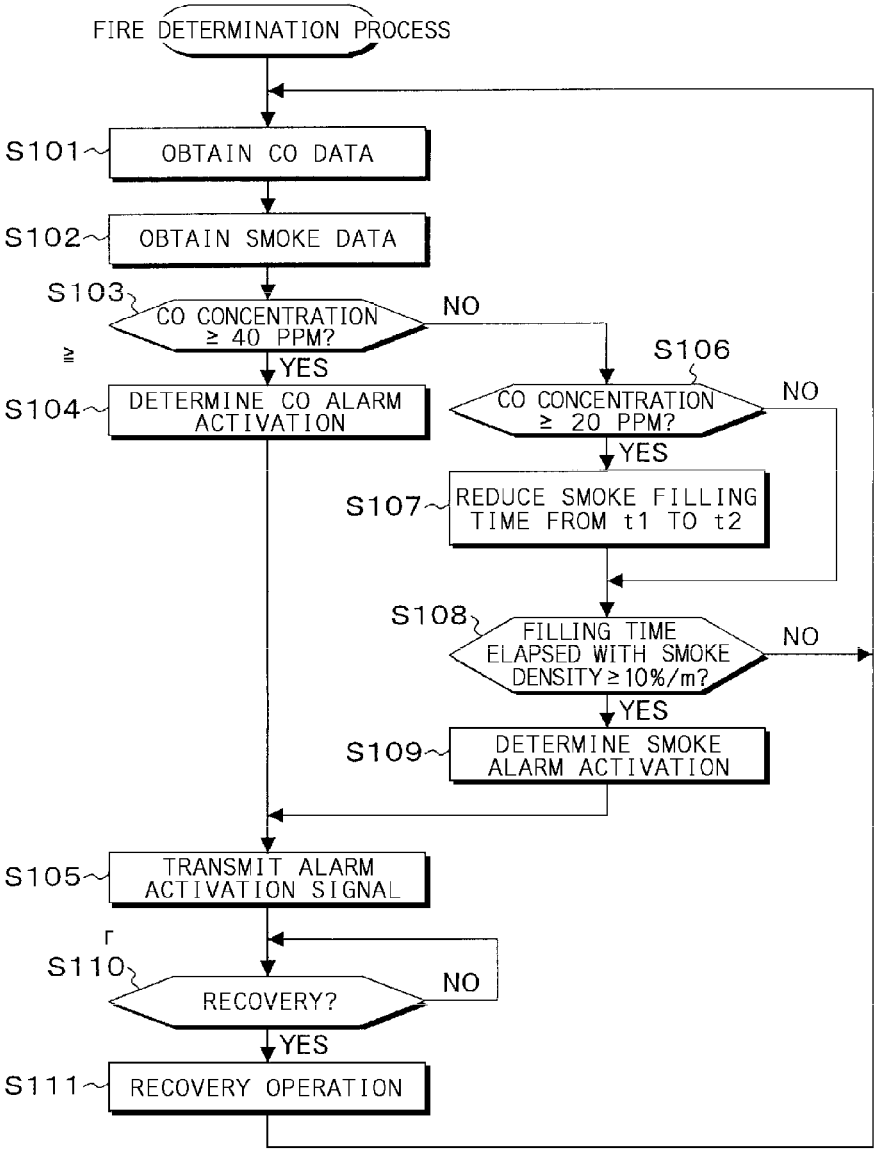
FIG. 8 is a flowchart showing another fire determination process by the detector circuit in FIG. 6.

FIG. 8 is a flowchart showing another fire determination process performed by the fire determination section 72 provided in the processor 62 of the detector circuit shown in FIG. 6, characterized by an emphasis process of reducing smoke filling time used for fire determination when the CO concentration exceeds a threshold.

In FIG. 8, steps S101-S105 and steps S110-S111 are the same processings as steps S1-S5 and steps S10-S11 in FIG. 7, respectively.

In this embodiment, a smoke filling time t1 is initially set to, e.g., t1=30 seconds. However, if determined in step S106 that the CO concentration is equal to or more than 20 ppm, since it is very likely due to a fire, the process proceeds to step S107 to perform an emphasis process of reducing the initially set smoke filling time t1=30 seconds to a less smoke filling time t2, e.g., t2=20 seconds.

After reducing the smoke filling time from t1=30 seconds to t2=20 seconds in step S107, if the process determines in step 108 that a state with a smoke density equal to or more than a predetermined threshold for fire determination, e.g., 10%/m, continues for the smoke filling time t2=20 seconds, the process determines smoke alarm activation in step S109, then transmits an alarm activation signal to the receiver in step S105.

On the other hand, if determined in step S106 that the CO concentration is less than 20 ppm, the process does not perform the emphasis process of reducing the smoke filling time in step S107. Then in step 108, if the process determines that the state with a smoke density equal to or more than the threshold for fire determination of 10%/m continues for the initially set smoke filling time t1=30 seconds, the process determines smoke alarm activation in step S109, then transmits an alarm activation signal to the receiver in step S105.

Figure 9:
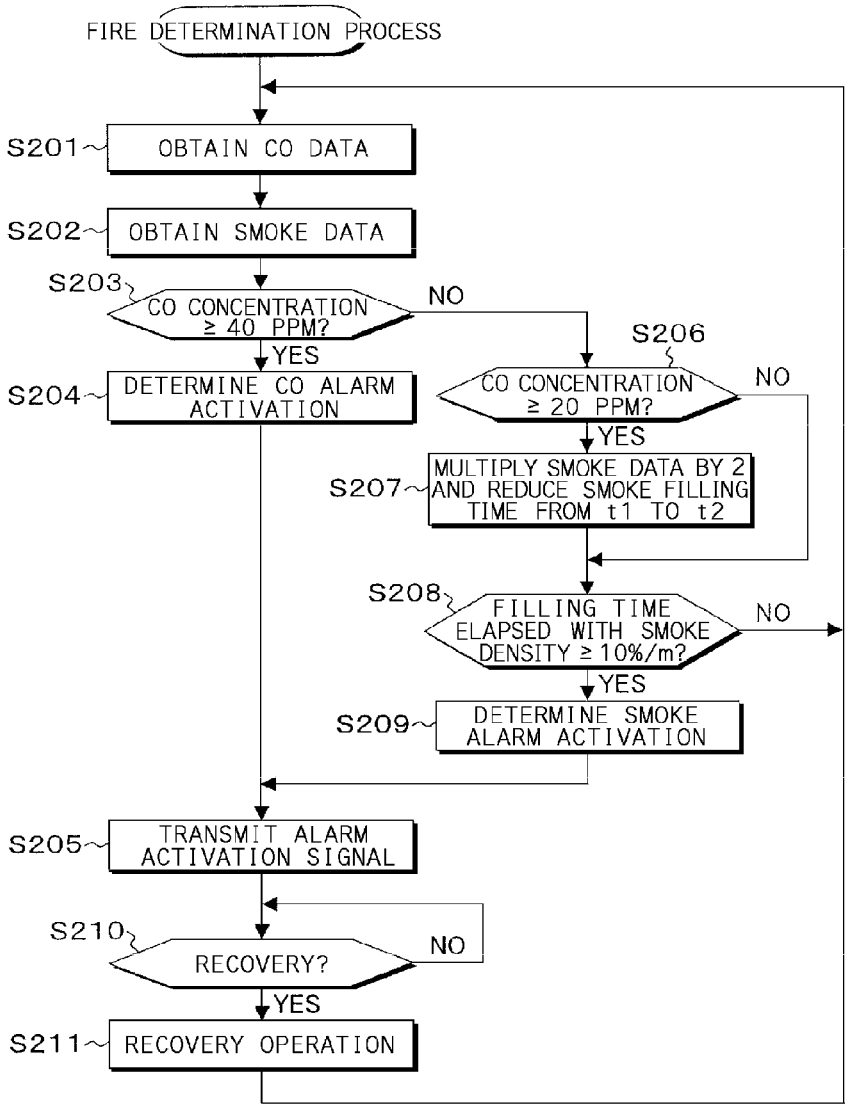
FIG. 9 is a flowchart showing another fire determination process by the detector circuit in FIG. 6.

FIG. 9 is a flowchart showing another fire determination process performed by the fire determination section 72 provided in the processor 62 of the detector circuit shown in FIG. 6, characterized by an emphasis process of multiplying smoke data by 2 and reducing smoke filling time when the CO concentration exceeds a threshold.

In FIG. 9, steps S201-S205 and steps S210-S211 are the same processings as steps S1-S5 and steps S10-S11 in FIG. 7, respectively.

In this embodiment, a smoke filling time t1 is initially set to, e.g., t1=30 seconds. However, if determined in step S206 that the CO concentration is equal to or more than 20 ppm, since it is very likely due to a fire, the process proceeds to step S207 to perform an emphasis process of reducing the initially set smoke filling time t1=30 seconds to a less smoke filling time t2, e.g., t2=20 seconds, and at the same time, emphasize smoke data by multiplying by, e.g., 2.

After reducing the smoke filling time and multiplying the smoke data by 2 in step S207, if the process determines in step 208 that a state with a smoke density equal to or more than a predetermined threshold for fire determination, e.g., 10%/m, continues for the smoke filling time t2=20 seconds, the process determines smoke alarm activation in step S209, then transmits an alarm activation signal to the receiver in step S205.

On the other hand, if determined in step S206 that the CO concentration is less than 20 ppm, the process does not perform the emphasis process of reducing the smoke filling time and multiplying the smoke data by 2 in step S207. Then in step 208, if the process determines that the state with a smoke density equal to or more than the threshold for fire determination of 10%/m continues for the initially set smoke filling time t1=30 seconds, the process determines smoke alarm activation in step S209, then transmits an alarm activation signal to the receiver in step S205.

Note that the smoke density determination in step S208 may also be performed such that two stages of thresholds for smoke alarm activation are set to 5%/m and 10%/m, then, if determined that a state with a smoke density equal to or more than the threshold of 5%/m continues for the smoke filling time t1 or t2, a pre-alarm is activated, and then, if determined that a state with a smoke density equal to or more than the threshold of 10%/m continues for the smoke filling time t1 or t2, a main-alarm is activated.

Figure 10:
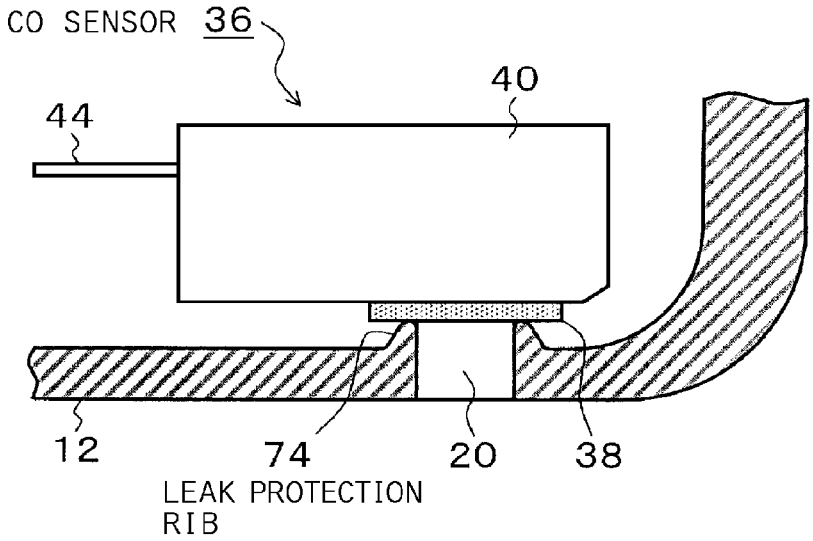
FIG. 10 is an illustration showing another embodiment of the CO sensor container, including a leak protection structure.
Figure 10:
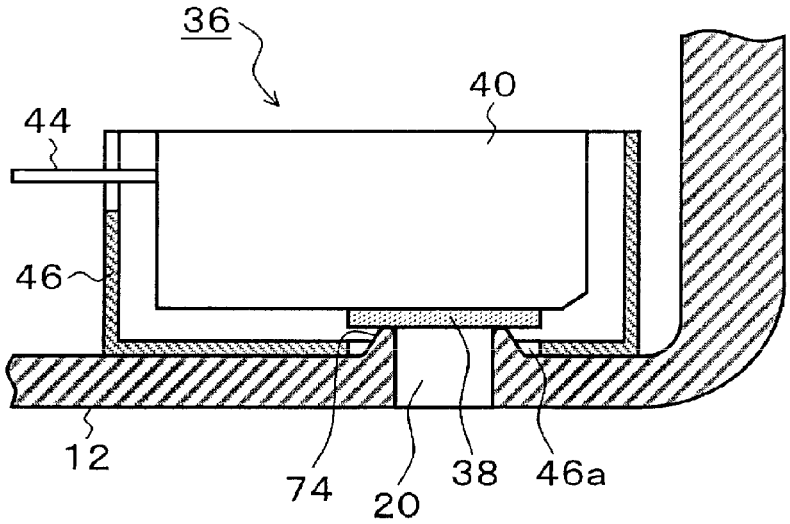

FIG. 10 is an illustration showing another embodiment of the CO sensor container, including a leak protection structure for preventing an electrolyte leaked out of a sensor from leaking to the outside of the detector. As shown in FIG. 10(A), on the inner side of the opening hole 20 open in the cover 12, a leak protection rib 74 is formed integrated with the cover 12, protruding inwardly from the inner surface of the cover 12. The water-repelling filter 38 is put on the whole circumference of the leak protection rib 74, and then the sensor main body 40 of the CO sensor 36 is placed such that the gas intake at the center of the water-repelling filter 38 is positioned within the opening of the opening hole 20.

Even when the CO sensor 36 has the electrolyte solution 41 filled therein as shown in FIG. 3(C) and the electrolyte solution 41 is covered by the water-repelling filter 38 with the gas intake facing downward as shown, the electrolyte solution 41 may leak from the gas intake to the outside due to some reason, such as aged deterioration. The electrolyte solution filled in the CO sensor 36 is, for example, dilute sulfuric acid. So, in the unlikely event that the electrolyte solution leaks to the outside, the electrolyte solution may leak from the detector to its installation site through the opening hole 20, causing human damage or property damage.

Thus, with the leak protection rib 74 provided, even when the electrolyte solution penetrates between the CO sensor 36 and the water-repelling filter 38 and leaks out from the outer edge of the filter 38, the electrolyte solution leaks out inside the cover 12, but the leak protection rib 74 reliably prevents the electrolyte solution from leaking out from the opening hole 20.

FIG. 10(B) shows an embodiment of the CO sensor container including the same leak protection structure, characterized in that the CO sensor 36 is contained in the shielding case 46 as with the case shown in FIG. 4(B).

Also in this embodiment in which the CO sensor 36 is contained in the shielding case 46, similarly to that shown in FIG. 10(A), the leak protection rib 74 is formed, protruding inwardly from the inner side of the opening hole 20 provided from the outer surface of the cover 12, and the water-repelling filter 38 for the detecting surface of the CO sensor 36 is put on the leak protection rib 74, then the CO sensor 36 is placed on the water-repelling filter 38 at the position corresponding to that of the leak protection rib 74. The shielding case 46 has a relatively large opening hole 46*a* so as not to interfere with the leak protection rib 74.

Also in the structure including the shielding case 46, with the leak protection rib 74 provided, even when the electrolyte solution filling the CO sensor 36 penetrates between the CO sensor 36 and the water-repelling filter 38 and leaks out from the edge of the filter, the leak protection rib 74 can reliably prevent the electrolyte solution from leaking out from the opening hole 20 to the outside.

Furthermore, contact between the water-repelling filter 38 and the leak protection rib 74 can prevent water or the like from penetrating the detector from the outside through the opening hole 20.

Figure 11:
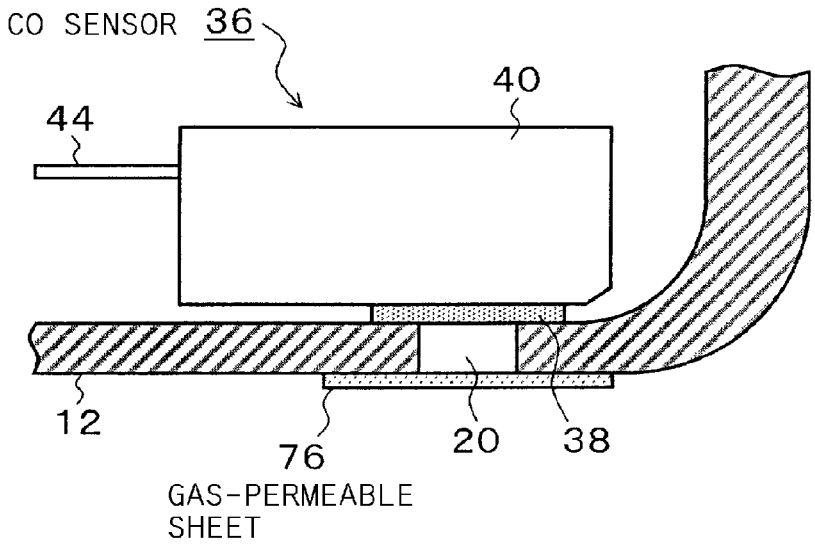
FIG. 11 is an illustration showing another embodiment of the CO sensor container, including a gas-permeable sheet on the outer side.
Figure 11:
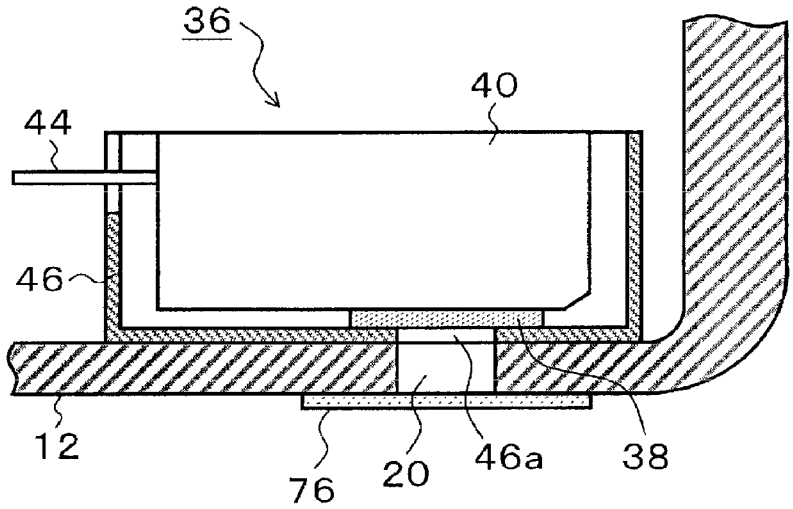

FIG. 11 is an illustration showing another embodiment of the CO sensor container, including a gas-permeable sheet on the outer side. As shown in FIG. 11(A), the CO sensor 36 is placed such that the gas intake of the sensor main body 40 is positioned within the opening of the opening hole 20 of the cover 12 with the water-repelling filter 38 in between. In addition, in the embodiment shown in FIG. 11(A), a gas-permeable sheet 76 is adhesively fixed on the outer side of the opening hole 20 open in the cover 12 so as to prevent water and dust from penetrating the opening hole 20.

The gas-permeable sheet 76 is formed using a sheet member that prevents water and dust from passing therethrough but allows CO gas as a detection target to pass therethrough. For example, a cloth sheet made of polytetrafluoroethylene (PTFE) also used for the water-repelling filter 38 may be used.

FIG. 11(B) shows an embodiment in which the CO sensor 36 is contained in the shielding case 46. Also in this embodiment, the gas-permeable sheet 76 is adhesively fixed on the outer side of the opening hole 20 of the cover 12 so as to prevent water and dust from penetrating the opening hole 20.

Figure 12:
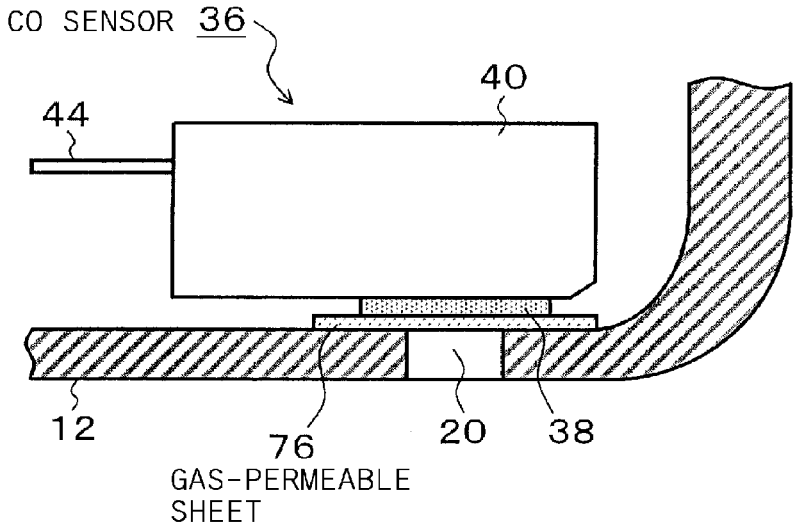
FIG. 12 is an illustration showing another embodiment of the CO sensor container, including a gas-permeable sheet on the inner side.
Figure 12:
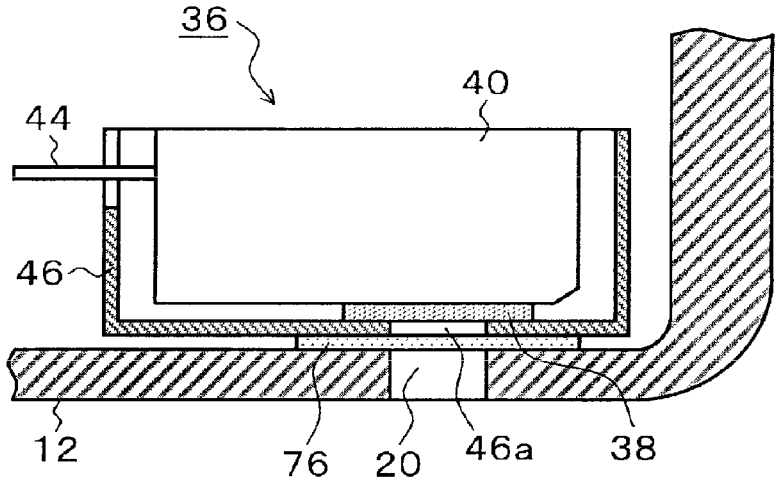

FIG. 12 is an illustration showing another embodiment of the CO sensor container, including a gas-permeable sheet on the inner side. In FIG. 10(A), the gas-permeable sheet 76 is adhesively fixed on the inner opening of the opening hole 20 provided in the cover 12, and the sensor main body 40 of the CO sensor 36 is placed on the gas-permeable sheet 76 with the water-repelling filter 38 in between. This gas-permeable sheet 76 is also formed using a cloth sheet made of polytetrafluoroethylene (PTFE) as in FIG. 11(A). This structure can protect the water-repelling filter 38 mounted on the surface of the CO sensor from water and impact from the outside and can strongly prevent water or the like from penetrating the detector.

FIG. 12(B) shows an embodiment in which the CO sensor 36 is contained in the shielding case 46 in the same structure as that in FIG. 12(A). In this embodiment, the gas-permeable sheet 76 is adhesively fixed on the inner side of the opening hole 20 of the cover 12, then the shielding case 46 is placed on the inner side of the gas-permeable sheet 76, and then the CO sensor 36 is built into the shielding case 46 with the water-repelling filter 38 placed opposite the opening hole 20.

The rib arrangement in FIG. 10 may be combined with the embodiments shown in FIGS. 11 and 12.

Figure 13:
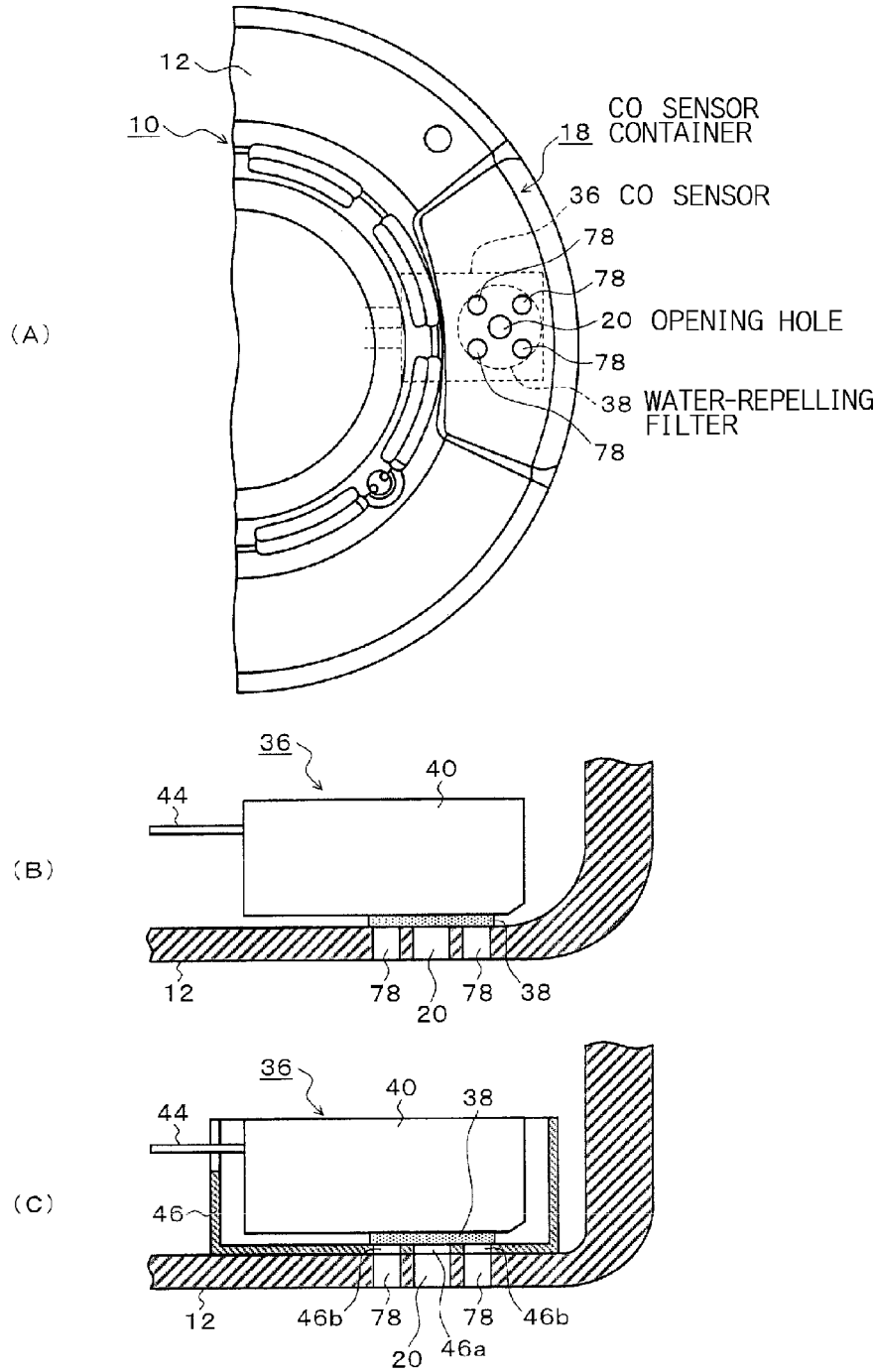
FIG. 13 is an illustration showing another embodiment of the CO sensor container, including a plurality of opening holes.

FIG. 13 is an illustration showing another embodiment of the CO sensor container, including a plurality of opening holes. FIG. 13(A) is a partial plan view seen from below of the detector 10. In the CO sensor container 18 formed by protruding the right portion of the cover 12, the opening hole 20 is formed opposite the gas intake of the CO sensor 36 contained in the CO sensor container 18 positioned at the center of the water-repelling filter 38, as in the embodiment shown in FIG. 1, and, in addition, in this embodiment, opening holes 78 are formed at four positions radiating out from the opening hole 20.

The four opening holes 78 are provided at the radiating positions that are inscribed in the area of the water-repelling filter 38 provided on the CO sensor 36, which are open such that the whole or any part of the openings does not exist outside the water-repelling filter 38.

FIG. 13(B) is a cross-sectional view of the CO sensor container in FIG. 13(A). As shown, the opening holes 78 are additionally formed around the opening hole 20 of the cover 12 at the positions opposite the water-repelling filter 38 provided on the detecting surface of the CO sensor 36.

Thus, with the plurality of opening holes 78 additionally provided around the opening hole 20, even when the gas permeability of the opening hole 20 is reduced due to deposition of dust or the like, CO gas can be introduced through the opening holes 78 provided around the opening hole 20, which can improve reliability of detecting CO gas against the deposition of dust or the like. Furthermore, with the opening holes 78, the CO sensor 36 can be protected against an external impact or the like, and can have higher CO gas sensitivity by increasing the area of the opening holes 78.

FIG. 13(C) shows an embodiment in which the CO sensor 36 is contained in the shielding case 46, in which the plurality of opening holes 78 are formed around the opening hole 20. In this embodiment, opening holes 46*b* are formed in the shielding case 46 at positions opposite the opening holes 78, so CO gas incoming through the opening holes 78 can pass through the water-repelling filter 38 without being blocked by the shielding case 46 and come into contact with the internal electrolyte solution through the gas intake provided in the sensor main body 40.

Note that, in FIGS. 13(B) and 13(C), the water-repelling filter 38 of the CO sensor 36 is in direct contact with the inner side of the opening holes 78 provided around the opening hole 20 at the center of the water-repelling filter 38. However, with a small clearance formed between the water-repelling filter 38 and the opening holes 78, when the opening hole 20 is stuffed up, CO gas can be efficiently introduced from the opening holes 78 through the water-repelling filter 38 to the gas intake at the center of the water-repelling filter 38.

Furthermore, in FIG. 13(C), the opening holes of the shielding case 46 are formed in the same manner as the opening holes 20 and 78 of the cover 12. However, the opening holes of the shielding case 46 may be one large opening hole as shown in FIG. 10(B). Increasing the area of the opening of the shielding case 46 allows CO gas to be efficiently introduced into the gas intake.

The configurations shown in FIGS. 10-12 may be combined with the embodiments shown in FIG. 13.

Second Embodiment

Next, a second embodiment is described. This embodiment relates to a detector including a smoke sensor, a gas sensor and, additionally, a temperature sensor. Note that, among components of the second embodiment, components not specifically described are intended to be similar to those of the first embodiment. The components similar to those of the first embodiment are appropriately denoted by the same numerals as those of the first embodiment, and will not be repeatedly described.

Figure 14:
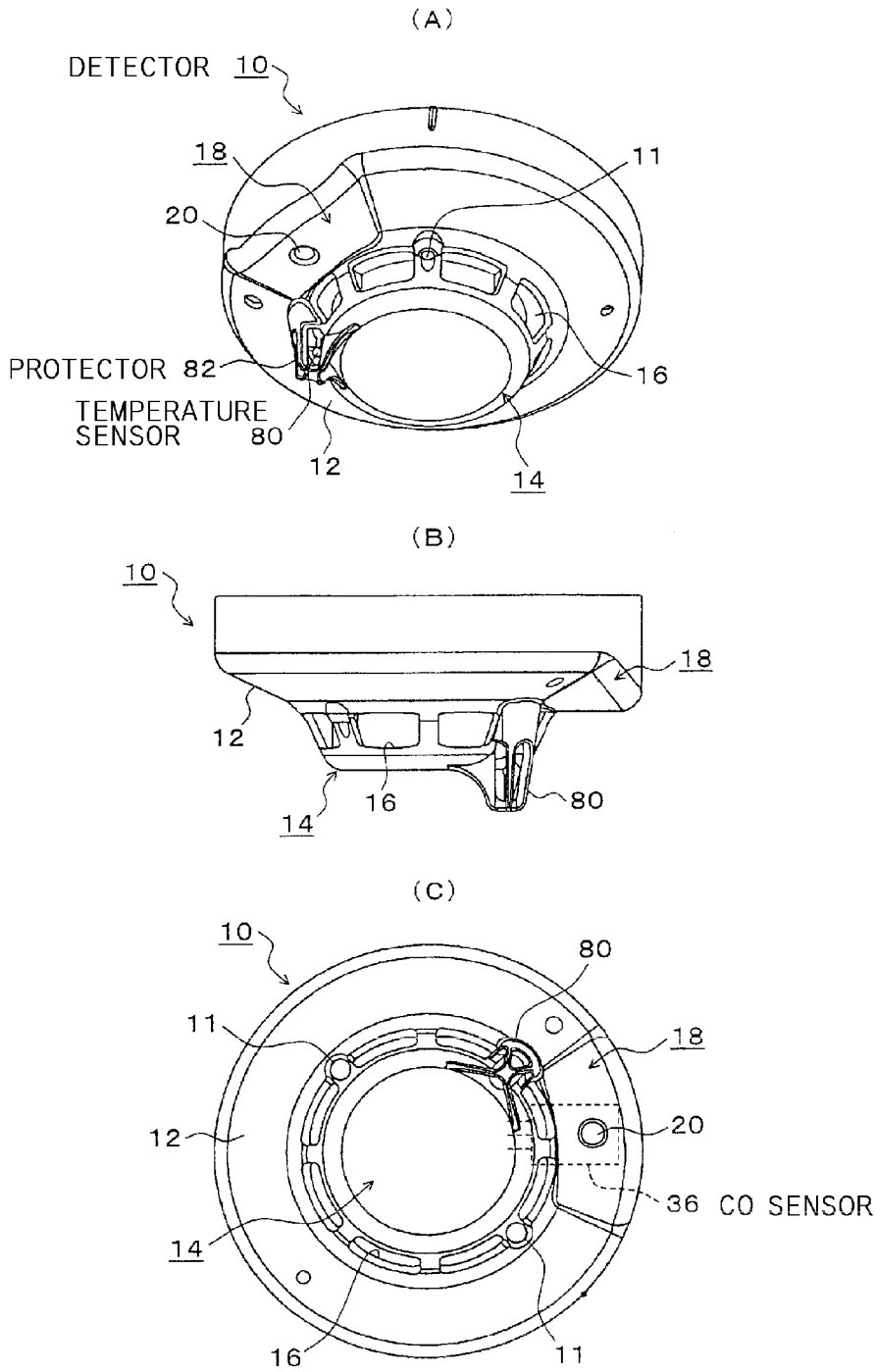
FIG. 14 is an illustration showing a second embodiment of the detector for detecting temperature, smoke and CO in accordance with the invention.

FIG. 14 is an illustration showing another embodiment of the detector in accordance with the invention, which detects heat (temperature), smoke and CO. FIG. 14(A) is a perspective view seen from below of the detector mounted on a ceiling surface. FIG. 14(B) is a side view of the detector. FIG. 14(C) is a plan view seen from below of the detector.

As shown in FIG. 14, the detector 10 of the embodiment includes: the smoke intakes 16 formed around the chamber container 14 protruding from the center of the approximately cylindrical cover 12; the CO sensor container 18 formed by protruding a portion of the outer part of the cover 12; and the opening hole 20 open in the CO sensor container 18 to introduce CO gas into the internal CO sensor 36. This is the same as the embodiment shown in FIG. 1.

Furthermore, in the embodiment shown in FIG. 14, a protector 82 as a gas-permeable cage-type frame body is formed protruding downwardly from a portion of the smoke intakes 16 formed around the chamber container 14, and a temperature sensor 80 is placed in the protector 82, as shown in FIG. 14(A). The temperature sensor 80 may be any appropriate temperature sensor, such as a thermister or semiconductor-type temperature sensor.

Note that the scattered-light type smoke detecting section and the CO sensor container have the same structures as those described for the embodiment shown in FIG. 1.

Figure 15:
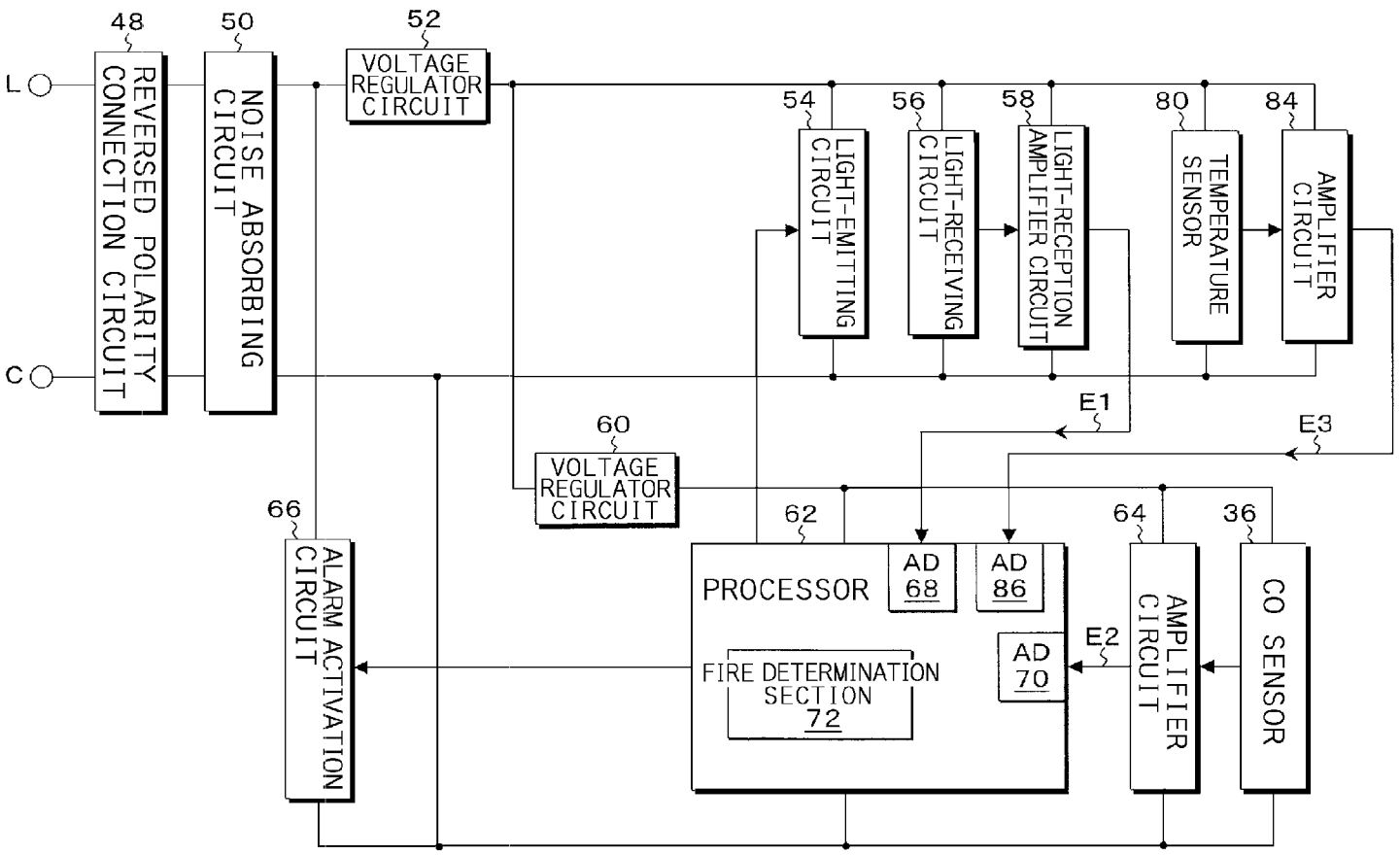
FIG. 15 is a block diagram showing a detector circuit in the embodiment in FIG. 14.

FIG. 15 is a block diagram showing a detector circuit in the embodiment shown in FIG. 14. In FIG. 15, the detector circuit newly includes a temperature sensor 80 and its amplifier circuit 84 powered by the voltage regulator circuit 52. Furthermore, the processor 62 includes an AD converter 86 for converting a temperature detection signal E3 from the amplifier circuit 84 that amplifies a detection signal from the temperature sensor 80, into temperature data. Furthermore, the fire determination section 72 of the processor 62 performs fire determination using CO data, smoke data and, additionally, temperature data. The rest of the components and operations are the same as those of the detector circuit shown in FIG. 6.

Figure 16:
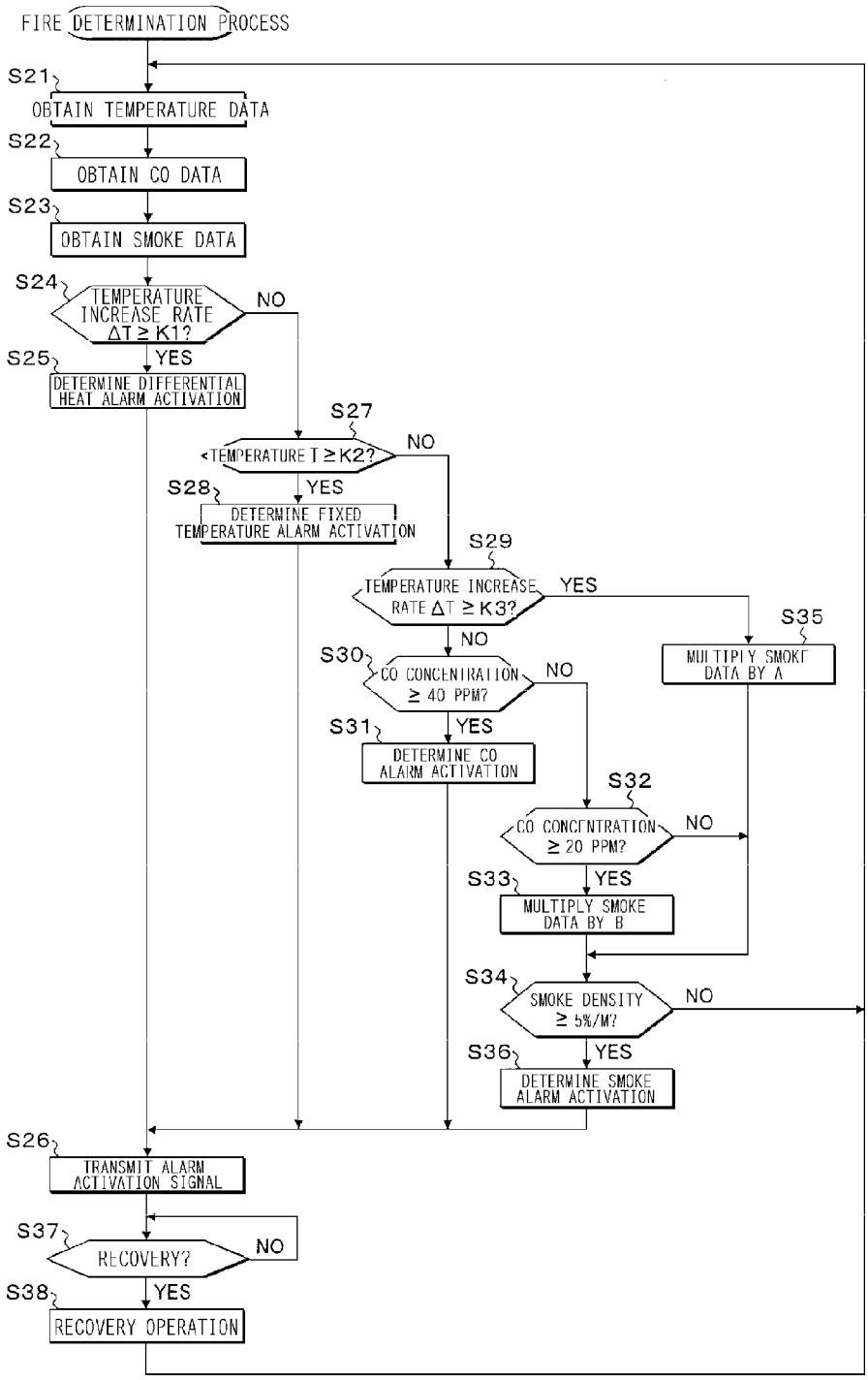
FIG. 16 is a flowchart showing a fire determination process by the detector circuit in FIG. 15.

FIG. 16 is a flowchart showing a fire determination process performed by the detector circuit shown in FIG. 15, which is a processing of the fire determination section 72 that is implemented by the processor 62 executing a program.

In FIG. 16, the fire determination process is a temperature prioritized process. The process, first, obtains temperature data in step S21, then, obtains CO data in step S22, and then, obtains smoke data in step S23.

Then, in step S24, the process determines a temperature increase rate ΔT from the difference between the new temperature data obtained in step S21 and previous temperature data, and determines whether or not the temperature increase rate ΔT is equal to or more than a predetermined threshold K1 of temperature increase rate. If determined that the temperature increase rate ΔT is equal to or more than the threshold K1, the process proceeds to step S25 to determine differential heat alarm activation, then transmits an alarm activation signal to the receiver in step S26.

If determined in step S24 that the temperature increase rate ΔT is less than the threshold K1, the process proceeds to step S27 to determine whether or not the temperature data T obtained in step S21 is equal to or more than a predetermined temperature threshold K2 for fire determination. If determined that the temperature data T is equal to or more than the threshold K2, the process proceeds to step S28 to determine fixed temperature alarm activation, then transmits an alarm activation signal to the receiver in step S26.

If determined in step S27 that the temperature data T is less than the threshold K2, the process proceeds to step S29 to determine whether or not the temperature increase rate ΔT is equal to or more than a temperature increase rate threshold K3 that is less than the threshold K1 of step S24. The temperature increase rate threshold K3 is a threshold that indicates that a fire has not occurred yet but is extremely likely to occur.

If determined in step S29 that the temperature increase rate ΔT is equal to or less than the threshold K3, the process proceeds to step S30 to determine whether or not the CO concentration is equal to or more than a threshold for fire determination, e.g., 40 ppm. If determined that the CO concentration is equal to or more than 40 ppm, the process proceeds to step S31 to determine CO alarm activation, then transmits an alarm activation signal to the receiver in step S26.

If determined in step S30 that the CO gas concentration is less than 40 ppm, the process proceeds to step S32 to determine whether or not the CO gas concentration is equal to or more than a predetermined concentration less than the threshold of step S30, e.g., 20 ppm. The threshold of 20 ppm is a threshold that indicates that a fire has not occurred yet but is extremely likely to occur.

If determined in step S32 that the CO concentration is equal to or more than 20 ppm, the process proceeds to step S33 to multiply the smoke data obtained in step S23, by B. B is a correction coefficient equal to or more than 1. Using B, the smoke data is converted to smoke data with a concentration more than that of the smoke data actually obtained.

Then, in step S34, the process determines whether or not the smoke density is equal to or more than a threshold for fire determination, e.g., 5%/m. If determined that the smoke density is equal to or more than 5%/m, the process determines fire alarm activation in step S37, then transmits an alarm activation signal to the receiver in step S26.

Furthermore, if determined in step S29 that the temperature increase rate ΔT is equal to or more than K3, the process multiplies the smoke data by A in step S35, then compares this multiplication result with the threshold of 5%/m in step S34. In the emphasis of multiplying the smoke data by A in step S35, the smoke data obtained in step S23 may be used as it is (A=1) or the smoke data may be emphasized using A equal to or more than 1 for smoke density determination in step S34.

After transmitting the alarm activation signal to the receiver in step S26, in step S37, if the process detects a power supply shut-off and a recovery after the shut-off of the detector line caused by a recovery operation on the receiver side, the process proceeds to step S38 to perform the recovery operation and then return to the normal-monitoring state in step S21. Note that the recovery operation may also be automatically performed by the detector, and also after a fire is detected, obtaining data from the sensors and determining a fire may be repeatedly performed.

Figure 17:
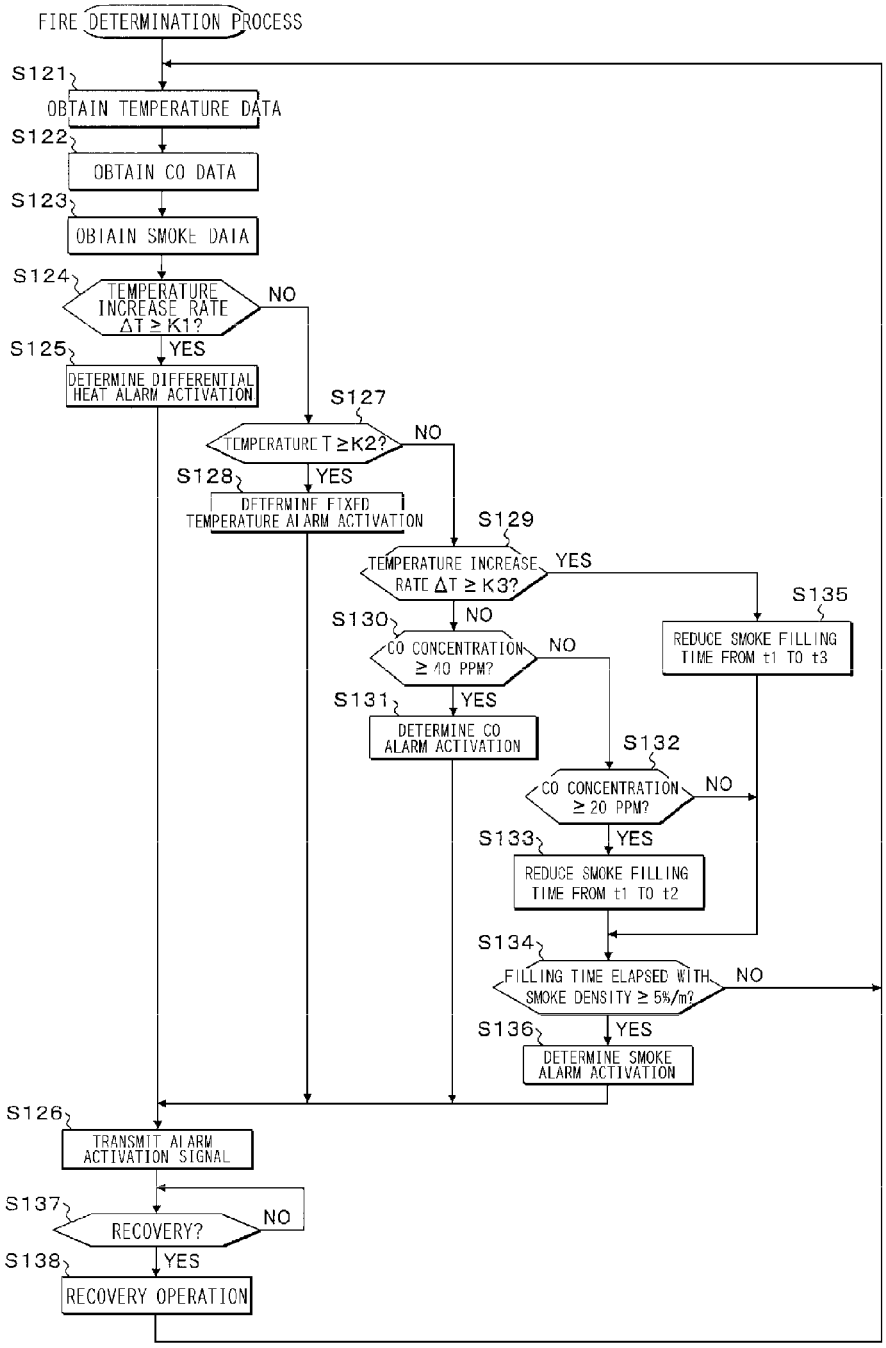
FIG. 17 is a flowchart showing another fire determination process by the detector circuit in FIG. 15.

FIG. 17 is a flowchart showing another fire determination process performed by the fire determination section 72 provided in the processor 62 of the detector circuit shown in FIG. 15, characterized by an emphasis process of reducing smoke filling time when The CO concentration exceeds a threshold.

In FIG. 17, steps S121-S128 and steps S137-S138 are the same processings as steps S21-S28 and steps S37-S38 in FIG. 16, respectively.

In this embodiment, a smoke filling time t1 is initially set to, e.g., t1=30 seconds. If determined in step S129 that the temperature increase rate ΔT is less than the threshold K3, the process proceeds to step S130 to determine whether or not the CO concentration is equal to or more than a threshold for fire determination, e.g., 40 ppm. If determined that the CO concentration is equal to or more than 40 ppm, the process proceeds to step S131 to determine CO alarm activation, then transmits an alarm activation signal to the receiver in step S126.

If determined in step S130 that the CO gas concentration is less than 40 ppm, the process proceeds to step S132 to determine whether or not the CO gas concentration is equal to or more than a predetermined concentration less than the threshold of step S130, e.g., 20 ppm. The threshold of 20 ppm is a threshold that indicates that a fire has not occurred yet but is extremely likely to occur.

If determined in step S132 that the CO concentration is equal to or more than 20 ppm, the process proceeds to step S133 to perform an emphasis process of reducing the initially set smoke filling time t1=30 seconds to a less smoke filling time t2, e.g., t2=20 seconds.

After reducing the smoke filling time from t1=30 seconds to t2=20 seconds in step S133, if the process determines in step 134 that a state with a smoke density equal to or more than a predetermined threshold for fire determination, e.g., 5%/m, continues for the smoke filling time t2=20 seconds, the process determines smoke alarm activation in step S136, then transmits an alarm activation signal to the receiver in step S126.

On the other hand, if determined in step S132 that the CO concentration is less than 20 ppm, the process does not perform the emphasis process of reducing the smoke filling time in step S133. Then in step 134, if the process determines that the state with a smoke density equal to or more than the threshold for fire determination of 5%/m continues for the initially set smoke filling time t1=30 seconds, the process determines smoke alarm activation in step S136, then transmits an alarm activation signal to the receiver in step S126.

Furthermore, if determined in step S129 that the temperature increase rate ΔT exceeds K3, the process proceeds to step S135 to perform an emphasis process of reducing the initially set smoke filling time t1=30 seconds to a smoke filling time t3 much less than the smoke filling time t2=20 seconds, e.g., t3=10 seconds.

After reducing the smoke filling time from t1=30 seconds to t3=10 seconds in step S129, if the process determines in step 134 that a state with a smoke density equal to or more than a predetermined threshold for fire determination, e.g., 5%/m, continues for the smoke filling time t3=10 seconds, the process determines smoke alarm activation in step S136, then transmits an alarm activation signal to the receiver in step S126.

Figure 18:
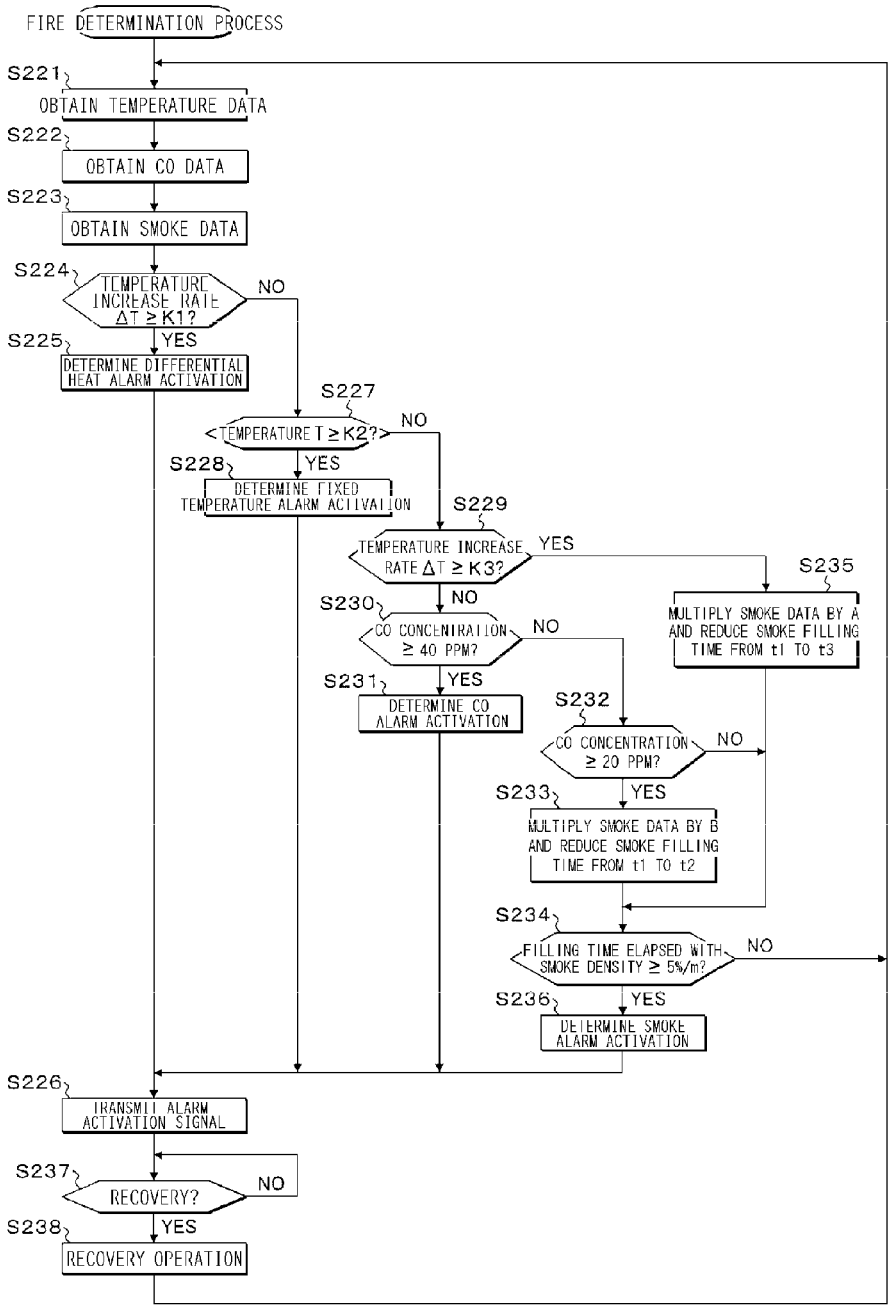
FIG. 18 is a flowchart showing another fire determination process by the detector circuit in FIG. 15.

FIG. 18 is a flowchart showing another fire determination process performed by the fire determination section 72 provided in the processor 62 of the detector circuit shown in FIG. 15, characterized by an emphasis process of multiplying smoke data by some number and reducing smoke filling time when the CO concentration exceeds a threshold.

In FIG. 18, steps S221-S228 and steps S237-S238 are the same processings as steps S21-S28 and steps S37-S38 in FIG. 16, respectively.

In this embodiment, a smoke filling time t1 is initially set to, e.g., t1=30 seconds. If determined in step S229 that the temperature increase rate ΔT is less than the threshold K3, the process proceeds to step S230 to determine whether or not the CO concentration is equal to or more than a threshold for fire determination, e.g., 40 ppm. If determined that the CO concentration is equal to or more than 40 ppm, the process proceeds to step S231 to determine CO alarm activation, then transmits an alarm activation signal to the receiver in step S226.

If determined in step S230 that the CO gas concentration is less than 40 ppm, the process proceeds to step S232 to determine whether or not the CO gas concentration is equal to or more than a predetermined concentration less than the threshold of step S230, e.g., 20 ppm. The threshold of 20 ppm is a threshold that indicates that a fire has not occurred yet but is extremely likely to occur.

If determined in step S232 that the CO concentration is equal to or more than 20 ppm, the process proceeds to step S233 to perform an emphasis process of multiplying the smoke data by B and reducing the initially set smoke filling time t1=30 seconds to a less smoke filling time t2, e.g., t2=20 seconds. B is a correction coefficient equal to or more than 1.

After multiplying the smoke data by B and reducing the smoke filling time from t1=30 seconds to t2=20 seconds in step S233, if the process determines in step 234 that a state with a smoke density equal to or more than a predetermined threshold for fire determination, e.g., 5%/m, continues for the smoke filling time t2=20 seconds, the process determines smoke alarm activation in step S236, then transmits an alarm activation signal to the receiver in step S226.

On the other hand, if determined in step S232 that the CO concentration is less than 20 ppm, the process does not perform the emphasis process of multiplying the smoke data by B and reducing the smoke filling time in step S233. Then in step 234, if the process determines that the state with a smoke density equal to or more than the threshold for fire determination of 5%/m continues for the initially set smoke filling time t1=30 seconds, the process determines smoke alarm activation in step S236, then transmits an alarm activation signal to the receiver in step S226.

Furthermore, if determined in step S229 that the temperature increase rate ΔT is equal to or more than K3, the process proceeds to step S235 to perform an emphasis process of multiplying the smoke data by A and reducing the initially set smoke filling time t1=30 seconds to a smoke filling time t3 much less than the smoke filling time t2=20 seconds, e.g., t3=10 seconds. Note that the smoke data obtained in step S223 may be used as it is (A=1) or the smoke data may be emphasized using A equal to or more than 1.

After multiplying the smoke data by A and reducing the smoke filling time from t1=30 seconds to t3=10 seconds in step S235, if the process determines in step 234 that a state with a smoke density equal to or more than a predetermined threshold for fire determination, e.g., 5%/m, continues for the smoke filling time t3=10 seconds, the process determines smoke alarm activation in step S236, then transmits an alarm activation signal to the receiver in step S226.

Third Embodiment

Next, a third embodiment is described. This embodiment relates to a detector including a smoke sensor, a gas sensor and, additionally, a temperature sensor as with the second embodiment, but having a different structure from the detector of the second embodiment. Note that, among components of the third embodiment, components not specifically described are intended to be similar to those of the second embodiment. The components similar to those of the second embodiment are appropriately denoted by the same numerals as those of the second embodiment, and will not be repeatedly described.

Figure 19:
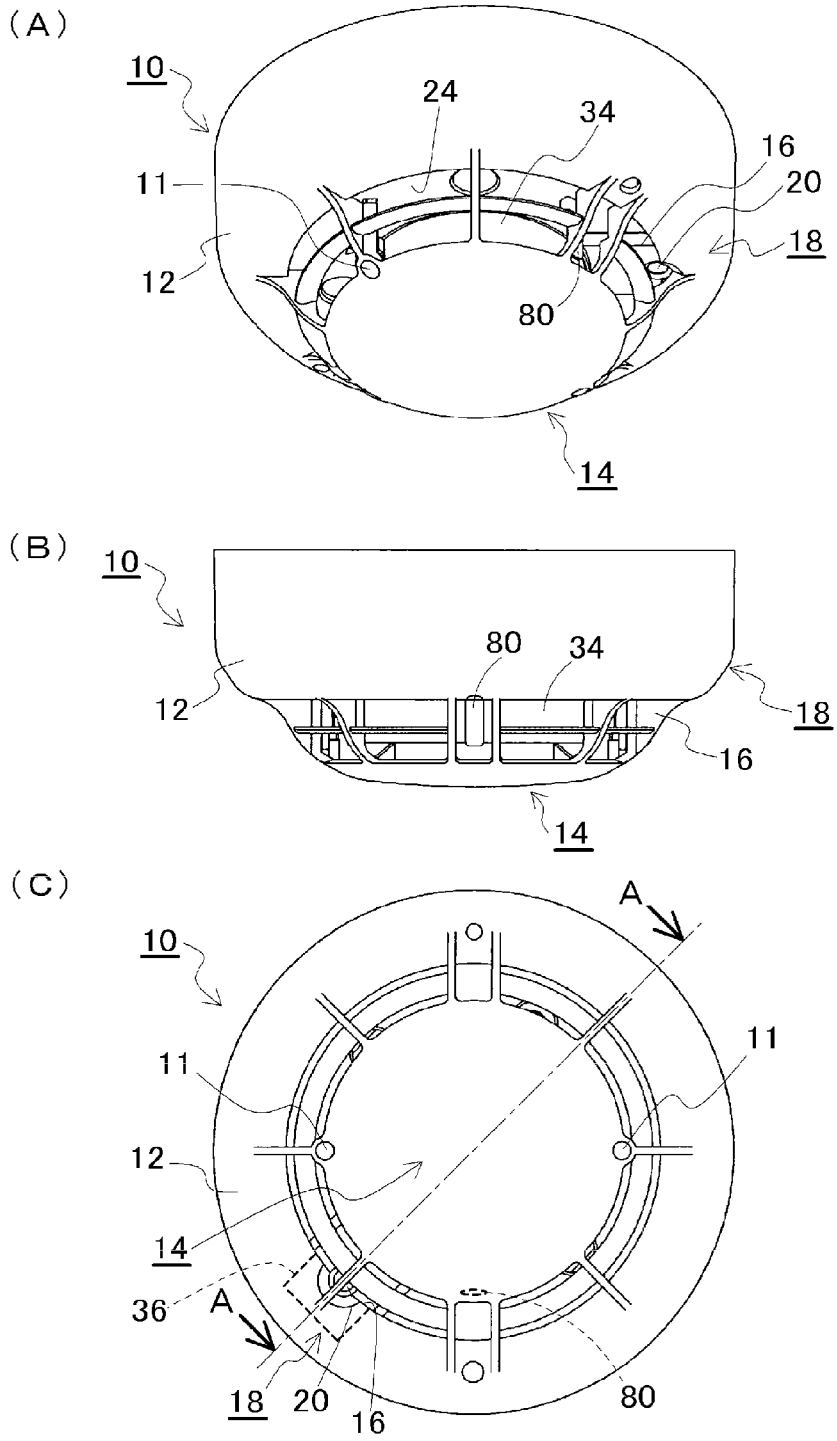
FIG. 19 is an illustration showing a third embodiment of the detector for detecting temperature, smoke and CO in accordance with the invention.

FIG. 19 is an illustration showing another embodiment of the detector in accordance with the invention, which detects heat, smoke and CO. FIG. 19(A) is a perspective view seen from below of the detector mounted on a ceiling surface. FIG. 19(B) is a side view of the detector. FIG. 19(C) is a plan view seen from below of the detector. Furthermore, FIG. 20 is a cross-sectional view taken in the direction indicated by the arrows A-A in FIG. 19(C).

Figure 20:
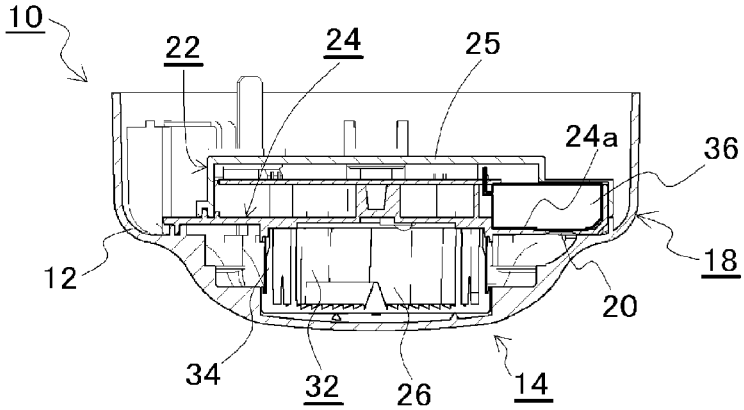
FIG. 20 is a cross-sectional view taken in the direction indicated by the arrows A-A in FIG. 19(C).

In FIGS. 19 and 20, the detector 10 of the embodiment includes: the plurality of smoke intakes (intakes) 16 formed around the chamber container (container) 14 protruding from the center of the approximately cylindrical cover (detector cover) 12; and the chamber 26 serving as a smoke detecting space (detecting space section) placed in the chamber container 14. The scattered-light type smoke detecting section thus configured has the same structure as that of the second embodiment shown in FIG. 14.

The temperature sensor 80 is placed in the chamber container 14 between the smoke intakes 16 and the chamber 26. Specifically, the temperature sensor 80 is placed protruding downwardly from a smoke detecting section main body plate 24*a* formed as part of the smoke detecting section main body 24 in parallel with the ceiling surface, to the side of the chamber 26. This causes hot air current flowing from the outside through the smoke intakes 16 into the chamber container 14 to hit the temperature sensor 80 with which the temperature of the hot air current can be measured. Particularly, the outer surface of the cover 12 is formed in a smoothly curved shape from the cylindrical base to the chamber container 14 so that hot air current rising from a fire source and flowing along the ceiling surface smoothly moves along the outer surface of the cover 12 to reach the smoke intakes 16. So, the hot air current incoming through the smoke intakes 16 smoothly hits the temperature sensor 80, enabling early temperature measurement. Especially, hot air current hits the temperature sensor 80 without routing through the chamber 26, enabling early temperature measurement. Note that the temperature sensor 80 may be any appropriate temperature sensor, such as a thermister or semiconductor-type temperature sensor, as with the second embodiment.

Figure 21:
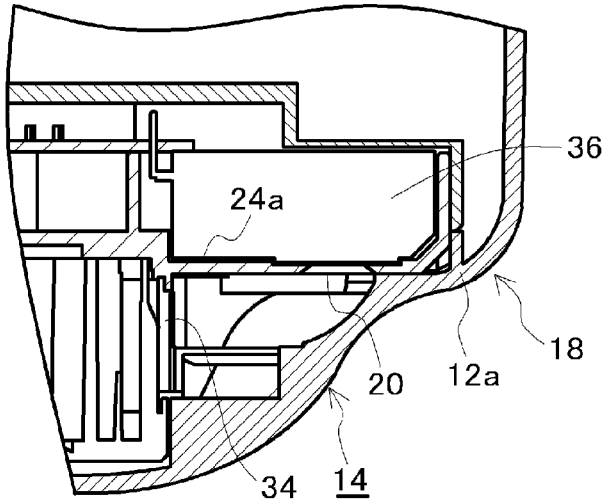
FIG. 21 is an enlarged view of the CO sensor container and its surroundings in FIG. 20.

Furthermore, the CO sensor container 18 is provided on one side of the cover 12 that is formed in a smoothly curved shape as described above, without protruding a portion of the outer part of the cover 12. FIG. 21 is an enlarged view of the CO sensor container 18 and its surroundings shown in FIG. 20. Specifically, the CO sensor container 18 is placed near a smoothly shaped corner 12*a* from the cylindrical base to the chamber container 14, in which the CO sensor 36 is placed. The CO sensor 36 is placed at a position on the smoke detecting section main body plate 24*a* closer to the lateral edge in the figure than the chamber 26. The smoke detecting section main body plate 24*a*, which is part of the smoke detecting section main body 24, is a plate-like body that separates the CO sensor 36 and the chamber container 14 from each other. Then, the opening hole 20 is formed in the smoke detecting section main body plate 24*a* at a position facing the chamber container 14 and outside the chamber 26. In other words, the opening hole 20 is formed at a position, closer to the inside of the cover 12 (closer to the chamber 26) than the smoke intakes 16, that is communicated with a space between the chamber 26 and the smoke intakes 16 in the chamber container 14. According to this structure, hot air current flows through the smoke intakes 16 and the opening hole 20 sequentially and without routing through the chamber 26 to reach the CO sensor 36, enabling early gas measurement. Particularly, as described above, since the outer surface of the cover 12 is formed in a smoothly curved shape from the cylindrical base to the chamber container 14, hot air current incoming through smoke intakes 16 smoothly flows into the CO sensor container 18 through the opening hole 20, enabling early gas measurement. Furthermore, the opening hole 20 has a conically-shaped hole in which a diameter far from the detector is larger than a diameter near the detector, allowing gas to flow more smoothly into the CO sensor container 18. Note that the CO sensor 36 may be an electrochemical CO sensor as with the first embodiment. Furthermore, not shown in the figure, the water-repelling filter and the shielding case may be provided as with the first embodiment.

Figure 22:
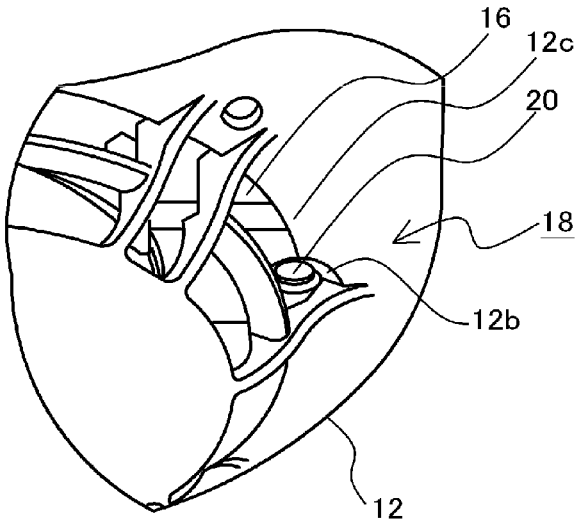
FIG. 22 is a partially enlarged view of FIG. 19(A).
Figure 23:
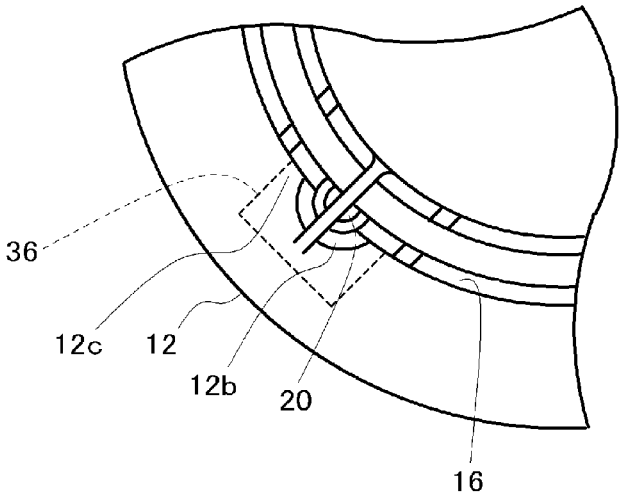
FIG. 23 is a partially enlarged view of FIG. 19(C).

Furthermore, an opening hole 12*b* is formed also in the cover 12 to allow hot air current to flow more smoothly into the opening hole 20. FIG. 22 is a partially enlarged view of FIG. 19(A). FIG. 23 is a partially enlarged view of FIG. 19(C). As shown in FIGS. 22 and 23, an outer part 12*c* of the smoke intakes 16 of the cover 12 is positioned on the extended line of the opening hole 20 (i.e., the line passing through the center of the opening hole 20 and perpendicular to the plane in which the opening hole 20 is formed (here, the plane of the smoke detecting section main body plate 24*a*)). So, the outer part 12*c* may interfere with hot air current flowing into the opening hole 20. Thus, an opening hole having a shape corresponding to the opening hole 20 (a notch having a semicircular planar shape) 12*b* is formed in the outer part 12*c* so that the outer part 12*c* will not interfere with hot air current flowing into the opening hole 20 through the opening hole 12*b*. Furthermore, the opening hole 12*b* also has a conically-shaped hole in which a diameter far from the detector is larger than a diameter near the detector, similar to that of the opening hole 20, allowing gas to flow much more smoothly into the CO sensor container 18.

Furthermore, unlike the first and second embodiments, in this embodiment, a portion of the outer part of the cover 12 is not protruded. So, the outer shape of the cover 12 can be uniformly shaped, eliminating the protruded portion that would interfere with hot air current flowing along the outer surface of the cover 12 and into the smoke intakes 16, allowing the hot air current to flow more smoothly into the smoke intakes 16.

Variation

While the embodiment of the invention has been described above, the specific configuration and means of the invention can be appropriately modified and improved within the technical scope of the invention according to the claims. Such a variation is described below.

For a position for forming the opening hole 20, the first and second embodiments show the examples in which the opening hole 20 is formed in the surface of the cover 12, and the third embodiment shows the example in which the opening hole 20 is formed at a position facing the chamber container 14 and outside the chamber 26. Obviously from the above, the opening hole 20 only needs to be formed so as to be open to a flow path of hot air current from the surface of the cover 12 through the intake to the detecting space section. For example, for a detector for detecting a fire from temperature (heat) and detecting gas, the cover 12 includes the detecting space section in which the temperature sensor 80 is placed and includes the intakes around the detecting space section. So, the opening hole 20 only needs to be formed on the surface of the cover 12 or at a position facing the container and outside the detecting space section.

In the above embodiments, the detector that is connected to the detector line from the P-type receiver and causes an alarm activation current to flow in response to a fire alarm activation is taken as an example. However, for a detector connected to an R-type receiver to be taken as an example, a transmission circuit for performing data transmission between the detector and the receiver may be provided in the detector.

In providing the transmission circuit connected to the R-type receiver in this way, for the determination result of the fire determination process shown in FIG. 7, the type of alarm activation, such as a CO alarm activation, smoke alarm activation, differential heat alarm activation and fixed temperature alarm activation, may be transmitted to the receiver instead of transmitting a fire alarm activation. Furthermore, instead of determining a fire alarm activation in the detector, CO data, smoke data and temperature data may be transmitted to the receiver to determine a fire alarm activation in the receiver.

Furthermore, in the above embodiment, the CO sensor container is protruded from the detector cover. However, instead of protruding the detector cover, an opening hole may be provided open in the surface of the cover, and a CO sensor may be placed behind the opening hole.

Furthermore, fire determination based on CO data and smoke data, and fire determination based on temperature data, CO data and smoke data in the above embodiments are only an example. So, another fire determination method may be appropriately used. A composite-type detector including a temperature sensor and a gas sensor may also be used.

The gas sensor for detecting a fire is not limited to a CO sensor, but may be a $CO_2$ sensor or an odor sensor.

The CO sensor 36 is placed in the detector cover 12 at a position outer than the smoke intakes 16, and the opening hole 20 is open in the surface of the cover 12 at a position outer than the smoke intakes 16. However, the CO sensor 36 is not limited to this. The opening hole 20 may be open in the surface of the chamber container 14 at a position inner than the smoke intakes 16, and the CO sensor 36 may be placed between the lower portion of the chamber 26 and the cover 12 (chamber container 14).

Furthermore, in the above embodiments, the detector is connected to the fire receiver by signal line, and, when the detector determines a fire, the detector transmits an alarm activation signal to the fire receiver and the fire receiver gives a fire alarm. However, the configuration is not limited to this. The invention may also be applied to a detector that is not connected to the receiver, includes an alarm means, such as a buzzer, and gives a fire alarm by itself when determining a fire. The invention may also be applied to a detector that is powered by an internal battery and monitors alone a fire.

Furthermore, the invention may also be applied to cooperative detectors in which the detectors transmit information, such as a fire signal, to one another by wired or wireless connection, and, when one detector determines a fire, the one detector transmits a fire signal to the other detector or detectors to give a fire alarm.

Furthermore, the invention includes appropriate modifications which do not impair the object and advantage thereof, and further, the invention is not limited by just the numerical values shown in the above embodiments.

According to the above embodiments of the present invention, the following technical effects can be obtained.

With the configuration in which the electrochemical gas sensor is placed, not in the chamber in the detector main body, such as the smoke detecting section, but behind the opening hole open in the surface of the detector cover, allowing outside air in contact with the surface of the detector cover to directly flow into the gas sensor, when the detector receives hot air current, gas immediately flows into the cover opening hole and comes into contact with the electrochemical gas sensor that provides detection output of gas concentration, then, after some time delay, the smoke sensor provides detection output of smoke density and temperature by detecting smoke flowing into the chamber through the insect net and the labyrinth, which enables early fire determination and alarm activation based on the gas concentration detected first, enabling early detection of gas concentration in the early stage of a fire. Particularly, the electrochemical gas sensor, having high detection accuracy, allows early fire detection even in a low gas concentration environment in the early stage of a fire.

Furthermore, the gas-permeable sheet provided outside or inside the opening hole open in the detector cover can prevent a liquid from leaking to the inside and outside of the detector, allowing improvement in reliability of the detector. Furthermore, even in case that the electrolyte solution leaks out of the gas sensor main body, the electrolyte solution can be prevented from leaking out of the detector cover to damage human body or the like.

Furthermore, multiplying a detected value of smoke and temperature by correction coefficient for emphasis or varying a smoke filling time depending on gas concentration detected first allows quick fire determination based on smoke and temperature using a fire sensor.

DESCRIPTION OF REFERENCE NUMERALS AND SIGNS

10 detector
12 cover
12*a* corner
16 smoke intakes
18 CO sensor container
20, 46*a*, 46*b*, 78 opening hole(s)
22 detector main body
24 smoke detecting section main body
24*a* smoke detecting section main body plate
36 CO sensor
38 water-repelling filter
42 gas intake
46 shielding case
46*a* opening hole
72 fire determination section
74 leak protection rib
76 gas-permeable sheet

The invention claimed is:

1. A detector for detecting a fire and gas, comprising:

a detector cover that receives hot air current;

a fire sensor, placed inside the detector cover, for detecting a fire; and an electrochemical gas sensor, placed inside the detector cover, for detecting gas with an electrode by contacting the gas with an electrolyte solution, wherein, in the detector cover, a container for containing a detecting space section for detecting a fire by the fire sensor is provided and an intake for causing the hot air current to flow into the container is formed, and wherein an opening hole for introducing gas included in the hot air current into the electrochemical gas sensor is formed so as to be open to a flow path of the hot air current from a surface of the detector cover through the intake to the detecting space section, wherein the opening hole is formed in a plate-like body that separates the electrochemical gas sensor and the container, wherein the fire sensor is a smoke sensor that optically detects smoke, wherein the detecting space section is a chamber serving as a smoke detecting space, wherein the container is a chamber container for containing the chamber, wherein the intake is a smoke intake for causing smoke included in the hot air current to flow into the chamber container, and wherein the opening hole is formed at a position communicated with a space section between the chamber and the smoke intake in the chamber container so that the hot air current flows through the smoke intake and the opening hole sequentially and without routing through the chamber to reach the electrochemical gas sensor.

2. The detector according to claim 1, wherein the electrochemical gas sensor includes a water-repelling filter mounted covering a gas intake open to a detecting surface of a sensor main body, and wherein the opening hole of the detector cover has a diameter that is larger than that of the gas intake of the sensor main body and is smaller than that of the water-repelling filter.

3. The detector according to claim 1, wherein the electrochemical gas sensor includes a water-repelling filter mounted covering a gas intake open to a detecting surface of a sensor main body, and the electrochemical gas sensor is placed at a position at which the water-repelling filter is in contact with or close to the inside of the opening hole of the detector cover.

4. The detector according to claim 1, wherein the electrochemical gas sensor is contained in a shielding case and placed inside the detector cover.

5. The detector according to claim 1, wherein a leak protection structure for preventing an electrolyte solution contained in the electrochemical gas sensor from leaking to the outside is provided inside the opening hole open in the detector cover.

6. The detector according to claim 1, wherein a gas-permeable sheet is provided outside or inside the opening hole open in the detector cover.

7. The detector according to claim 1, wherein a plurality of the opening holes open in the detector cover are provided at positions opposite to a water-repelling filter provided on the electrochemical gas sensor.

8. The detector according to claim 1, wherein a fire determination unit for determining a fire based on smoke density and temperature detected by the fire sensor and gas concentration detected by the electrochemical gas sensor is further provided.

9. The detector according to claim 8, wherein the fire determination unit:

if the gas concentration is equal to or more than a predetermined gas threshold, determines a fire alarm activation to provide an alarm activation signal; and, if the gas concentration is less than the gas threshold and equal to or more than a second gas threshold set to be less than the gas threshold, multiplies the smoke density by a predetermined correction coefficient equal to or more than 1 to calculate a smoke density, and, if the calculated smoke density is equal to or more than a predetermined smoke threshold, determines a fire alarm activation to provide an alarm activation signal.

10. The detector according to claim 8, wherein the fire determination unit:

if the gas concentration is equal to or more than a predetermined gas threshold, determines a fire alarm activation to provide an alarm activation signal; and, if the gas concentration is less than the gas threshold and equal to or more than a second gas threshold set to be less than the gas threshold, reduces a smoke filling time for fire determination, and, when a state with a smoke density equal to or more than a predetermined smoke threshold continues for the reduced smoke filling time, determines a fire alarm activation to provide an alarm activation signal.

11. The detector according to claim 8, wherein the fire determination unit determines a fire preferentially based on temperature detected by the fire sensor, and, if a fire has not been determined based on the temperature, determines a fire based on the smoke density and gas concentration.

12. The detector according to claim 11, wherein the fire determination unit performs fire determination preferentially based on temperature by:

if increase rate of the temperature is equal to or more than a predetermined increase rate threshold, determining a fire alarm activation to provide an alarm activation signal;

if increase rate of the temperature is less than the increase rate threshold, determining a fire alarm activation to provide an alarm activation signal if the temperature is equal to or more than a predetermined temperature threshold; and if the temperature is less than the temperature threshold, determining a fire based on the smoke density and gas concentration.

13. A detector for detecting a fire and gas, comprising:

a detector cover that receives hot air current;

a fire sensor, placed inside the detector cover, for detecting a fire; and an electrochemical gas sensor, placed inside the detector cover, for detecting gas with an electrode by contacting the gas with an electrolyte solution, wherein, in the detector cover, a container for containing a detecting space section for detecting a fire by the fire sensor is provided and an intake for causing the hot air current to flow into the container is formed, and wherein an opening hole for introducing gas included in the hot air current into the electrochemical gas sensor is formed so as to be open to a flow path of the hot air current from a surface of the detector cover through the intake to the detecting space section, wherein the opening hole is formed in the surface of the detector cover, and wherein the electrochemical gas sensor is placed at a position at which the electrochemical gas sensor is in contact with or close to the inside of the opening hole of the detector cover.

14. The detector according to claim 13, wherein the electrochemical gas sensor includes a water-repelling filter mounted covering a gas intake open to a detecting surface of a sensor main body, and wherein the opening hole of the detector cover has a diameter that is larger than that of the gas intake of the sensor main body and is smaller than that of the water-repelling filter.

15. The detector according to claim 13, wherein the electrochemical gas sensor includes a water-repelling filter mounted covering a gas intake open to a detecting surface of a sensor main body, and the electrochemical gas sensor is placed at a position at which the water-repelling filter is in contact with or close to the inside of the opening hole of the detector cover.

16. The detector according to claim 13, wherein the electrochemical gas sensor is contained in a shielding case and placed inside the detector cover.

17. The detector according to claim 13, wherein a leak protection structure for preventing an electrolyte solution contained in the electrochemical gas sensor from leaking to the outside is provided inside the opening hole open in the detector cover.

18. The detector according to claim 13, wherein a gas-permeable sheet is provided outside or inside the opening hole open in the detector cover.

19. The detector according to claim 13, wherein a plurality of the opening holes open in the detector cover are provided at positions opposite to a water-repelling filter provided on the electrochemical gas sensor.

20. The detector according to claim 13, wherein a fire determination unit for determining a fire based on smoke density and temperature detected by the fire sensor and gas concentration detected by the electrochemical gas sensor is further provided.

21. The detector according to claim 20, wherein the fire determination unit:

if the gas concentration is equal to or more than a predetermined gas threshold, determines a fire alarm activation to provide an alarm activation signal; and, if the gas concentration is less than the gas threshold and equal to or more than a second gas threshold set to be less than the gas threshold, multiplies the smoke density by a predetermined correction coefficient equal to or more than 1 to calculate a smoke density, and, if the calculated smoke density is equal to or more than a predetermined smoke threshold, determines a fire alarm activation to provide an alarm activation signal.

22. The detector according to claim 20, wherein the fire determination unit:

if the gas concentration is equal to or more than a predetermined gas threshold, determines a fire alarm activation to provide an alarm activation signal; and, if the gas concentration is less than the gas threshold and equal to or more than a second gas threshold set to be less than the gas threshold, reduces a smoke filling time for fire determination, and, when a state with a smoke density equal to or more than a predetermined smoke threshold continues for the reduced smoke filling time, determines a tire alarm activation to provide an alarm activation signal.

23. The detector according to claim 20, wherein the fire determination unit determines a fire preferentially based on temperature detected by the fire sensor, and, if a fire has not been determined based on the temperature, determines a fire based on the smoke density and gas concentration.

24. The detector according to claim 23, wherein the fire determination unit performs fire determination preferentially based on temperature by:

if increase rate of the temperature is equal to or more than a predetermined increase rate threshold, determining a fire alarm activation to provide an alarm activation signal;

if increase rate of the temperature is less than the increase rate threshold, determining a fire alarm activation to provide an alarm activation signal if the temperature is equal to or more than a predetermined temperature threshold; and if the temperature is less than the temperature threshold, determining a fire based on the smoke density and gas concentration.

* * * * *